US007985097B2

(12) United States Patent
Gulla

(10) Patent No.: US 7,985,097 B2
(45) Date of Patent: Jul. 26, 2011

(54) ELECTRICAL CONNECTOR ASSEMBLY

(75) Inventor: Joseph M. Gulla, Nashua, NH (US)

(73) Assignee: Amphenol Corporation, Wallingford Center, CT (US)

( * ) Notice: Subject to any disclaimer, the term of this patent is extended or adjusted under 35 U.S.C. 154(b) by 415 days.

(21) Appl. No.: 11/961,341

(22) Filed: Dec. 20, 2007

(65) Prior Publication Data

US 2008/0214055 A1 Sep. 4, 2008

Related U.S. Application Data

(60) Provisional application No. 60/875,807, filed on Dec. 20, 2006.

(51) Int. Cl.
*H01R 13/658* (2011.01)

(52) U.S. Cl. ..... 439/607.39

(58) Field of Classification Search ..... 439/638, 439/637, 607.39

See application file for complete search history.

(56) References Cited

U.S. PATENT DOCUMENTS

| | | | | |
|---|---|---|---|---|
| 4,519,667 | A | | 5/1985 | Canning et al. |
| 4,786,258 | A | | 11/1988 | Shaffer et al. |
| 4,790,763 | A | | 12/1988 | Weber et al. |
| 4,795,379 | A | | 1/1989 | Sasaki et al. |
| 4,812,133 | A | | 3/1989 | Fleak et al. |
| 4,820,169 | A | | 4/1989 | Weber et al. |
| 4,826,443 | A | | 5/1989 | Lockard |
| 4,846,727 | A | | 7/1989 | Glover et al. |
| 4,867,597 | A | | 9/1989 | Denlinger et al. |
| 4,895,535 | A | | 1/1990 | Emadi et al. |
| 4,932,885 | A | | 6/1990 | Scholz |
| 4,934,950 | A | | 6/1990 | Green et al. |
| 5,041,023 | A | | 8/1991 | Lytle |
| 5,051,099 | A | * | 9/1991 | Pickles et al. ..... 439/108 |
| 5,062,809 | A | | 11/1991 | Sakamoto et al. |
| 5,096,443 | A | | 3/1992 | Myrick et al. |
| 5,173,063 | A | | 12/1992 | Barkus et al. |
| 5,199,884 | A | | 4/1993 | Kaufman et al. |
| 5,211,585 | A | | 5/1993 | Douty et al. |
| 5,919,049 | A | | 7/1999 | Petersen et al. |
| 6,024,579 | A | | 2/2000 | Bennett |
| 6,059,600 | A | | 5/2000 | Vanbesien |
| 6,109,949 | A | | 8/2000 | Suzuki et al. |
| 6,171,115 | B1 | | 1/2001 | Mickievicz et al. |
| 6,315,591 | B2 | | 11/2001 | Oda et al. |

(Continued)

OTHER PUBLICATIONS

Search Report and Written Opinion mailed Jul. 14, 2009 from International Application No. PCT/US2009/000316.

(Continued)

*Primary Examiner* — Briggitte R Hammond

(74) *Attorney, Agent, or Firm* — Wolf, Greenfield & Sacks, P.C.

(57) ABSTRACT

A ruggedized, two-piece electrical connector. One piece, which may be configured for mounting to a daughtercard, is assembled from wafers. Each wafer includes a shield member and signal contacts held by an insulative member. Within the insulative member, the signal and ground contacts run in spaced, parallel planes. Both signal and ground contacts terminate in pads along a mating segment of the connector. The second piece of the connector, which may be configured for mounting to a backplane, has a housing with slots to receive the mating segments of the wafers. Within the slots, the backplane connectors have contacts that provide at least four points of contact with each pad. The contact points are at least two different heights on each side of the pad.

10 Claims, 36 Drawing Sheets

U.S. PATENT DOCUMENTS

| | | | |
|---|---|---|---|
| 6,347,962 | B1 | 2/2002 | Kline |
| 6,454,603 | B2 | 9/2002 | Casey et al. |
| 6,641,420 | B2 | 11/2003 | Blanchfield et al. |
| 6,655,966 | B2 | 12/2003 | Rothermel et al. |
| 6,764,349 | B2 | 7/2004 | Provencher et al. |
| 6,811,440 | B1 | 11/2004 | Rothermel et al. |
| 6,824,391 | B2 | 11/2004 | Mickievicz et al. |
| 6,827,611 | B1 | 12/2004 | Payne et al. |
| 6,866,549 | B2 | 3/2005 | Kimura et al. |
| 6,899,548 | B2 | 5/2005 | Houtz |
| 6,942,509 | B2 | 9/2005 | Sasame et al. |
| 6,945,810 | B1 | 9/2005 | Morana et al. |
| 7,008,250 | B2 | 3/2006 | Shuey et al. |
| 7,044,794 | B2 | 5/2006 | Consoli et al. |
| 7,175,445 | B2 | 2/2007 | Consoli et al. |
| 7,182,616 | B2 | 2/2007 | Shuey et al. |
| 7,186,121 | B1 | 3/2007 | Costello et al. |
| 7,326,092 | B2 | 2/2008 | Fedder et al. |
| 2002/0098738 | A1 | 7/2002 | Astbury, Jr. et al. |
| 2005/0266728 | A1 | 12/2005 | Houtz |
| 2006/0003620 | A1 | 1/2006 | Daily et al. |
| 2006/0128203 | A1 | 6/2006 | Yosler |
| 2007/0021002 | A1 | 1/2007 | Laurx et al. |
| 2007/0037434 | A1 | 2/2007 | Fedder et al. |
| 2007/0042639 | A1 | 2/2007 | Manter et al. |

OTHER PUBLICATIONS

Written Opinion of the International Searching Authority mailed Jul. 2, 2009 from International Application No. PCT/US2007/026056.

International Search Report and Written Opinion for International Application No. PCT/US2007/026056 mailed Oct. 16, 2008.

* cited by examiner

ELECTRICAL CONNECTOR ASSEMBLY

RELATED APPLICATIONS

This Application claims priority to U.S. Provisional Application Ser. No. 60/875,807, entitled "ELECTRICAL CONNECTOR ASSEMBLY" filed on Dec. 20, 2006, which is herein incorporated by reference in its entirety.

BACKGROUND OF INVENTION

1. Field of Invention

The present invention relates generally to electronic assemblies and more specifically to electrical connectors for interconnecting circuit boards.

2. Discussion of Related Art

Electrical connectors are used in many electronic systems. It is generally easier and more cost effective to manufacture a system on several printed circuit boards ("PCBs") that are connected to one another by electrical connectors than to manufacture a system as a single assembly. A traditional arrangement for interconnecting several PCBs is to have one PCB serve as a backplane. Other PCBs, which are called daughter boards or daughter cards, are then connected through the backplane by electrical connectors.

Additionally, electrical connectors are used to make connections between other components of electronic assemblies. For example, electrical connectors may be used to connect daughter cards containing circuitry to motherboards, to connect extension boards to printed circuit boards, to connect cables to printed circuit boards or to connect chips to printed circuit boards.

Conventional circuit board electrical connectors are disclosed in the U.S. Pat. No. 6,824,391 to Mickievicz et al., U.S. Pat. No. 6,811,440 to Rothermel et al., U.S. Pat. No. 6,655,966 to Rothermel et al., U.S. Pat. No. 6,267,604 to Mickievicz et al., and U.S. Pat. No. 6,171,115 to Mickievicz et al., the subject matter of each of which is incorporated by reference.

Other examples of electrical connectors are shown in U.S. Pat. No. 6,293,827, U.S. Pat. No. 6,503,103 and U.S. Pat. No. 6,776,659, all of which are hereby incorporated by reference in their entireties.

SUMMARY OF INVENTION

In one aspect, the invention relates to a first connector having a mating segment. Conductive elements within the first connector terminate in pads on two surfaces of the mating segment. A second connector includes mating conductive elements that mate with the pads. The mating conductive elements include multiple contact surfaces, providing multiple points of contacts on each of the pads.

In a further aspect, the invention relates to a wafer for an electrical connector that includes first and second shielding members defining first and second grounding planes, and at least one signal contact disposed between the first and second shielding members. The signal contact has a first end terminal adapted for connection with a printed circuit board, and a second end terminal adapted for engaging a mating connector. The shielding members may be held together by a dielectric housing that substantially encapsulates the first and second shielding members.

In another aspect, the invention relates to an electronic assembly in which a guidance member in incorporated into a connector. By incorporating the guidance member in the connector, the use of a separate alignment pin may be avoided, freeing board space for fluid connections or other components.

In yet a further aspect, the invention relates to an electronic assembly including two connectors that mate. One connector is formed of wafers having mating segments and the other connector is formed with slots that receive the mating segments. The mating segments are adapted and arranged to allow float of the first connector relative to the second connector.

In yet a further aspect, the invention relates to an electrical connector assembled from wafers formed as printed circuit boards. Shock absorbing members are positioned between the printed circuit boards. Such a configuration may provide a more rugged connector.

In yet a further aspect, the invention relates to a contact for an electrical connector that facilitates a mating sequence with initially low insertion force, but that can generate sufficient retention force for a reliable electrical connection.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings:

FIG. 2*l* is a sketch of a backplane connector that may be used with a wafer assembly including the guidance module of FIG. 2*k;*

DETAILED DESCRIPTION

Figure 1A:
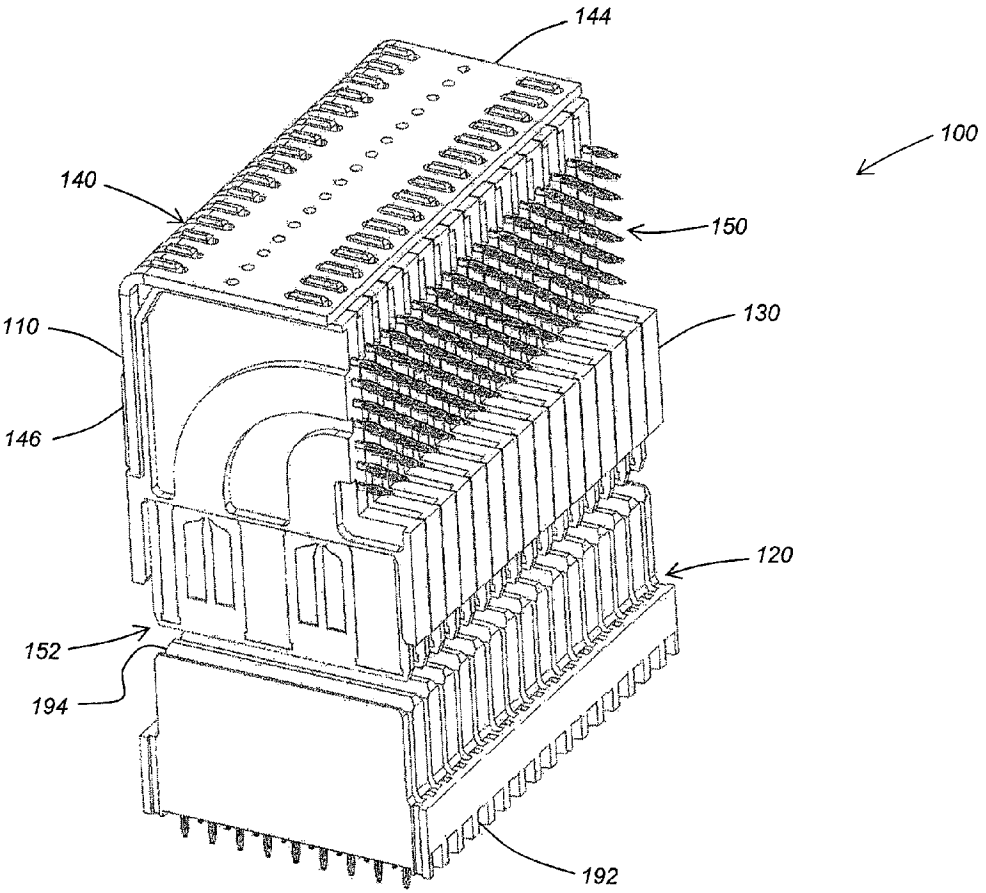
FIGS. 1*a*-1*c* illustrate one exemplary embodiment of a connector assembly in accordance with the present invention.
Figure 1B:
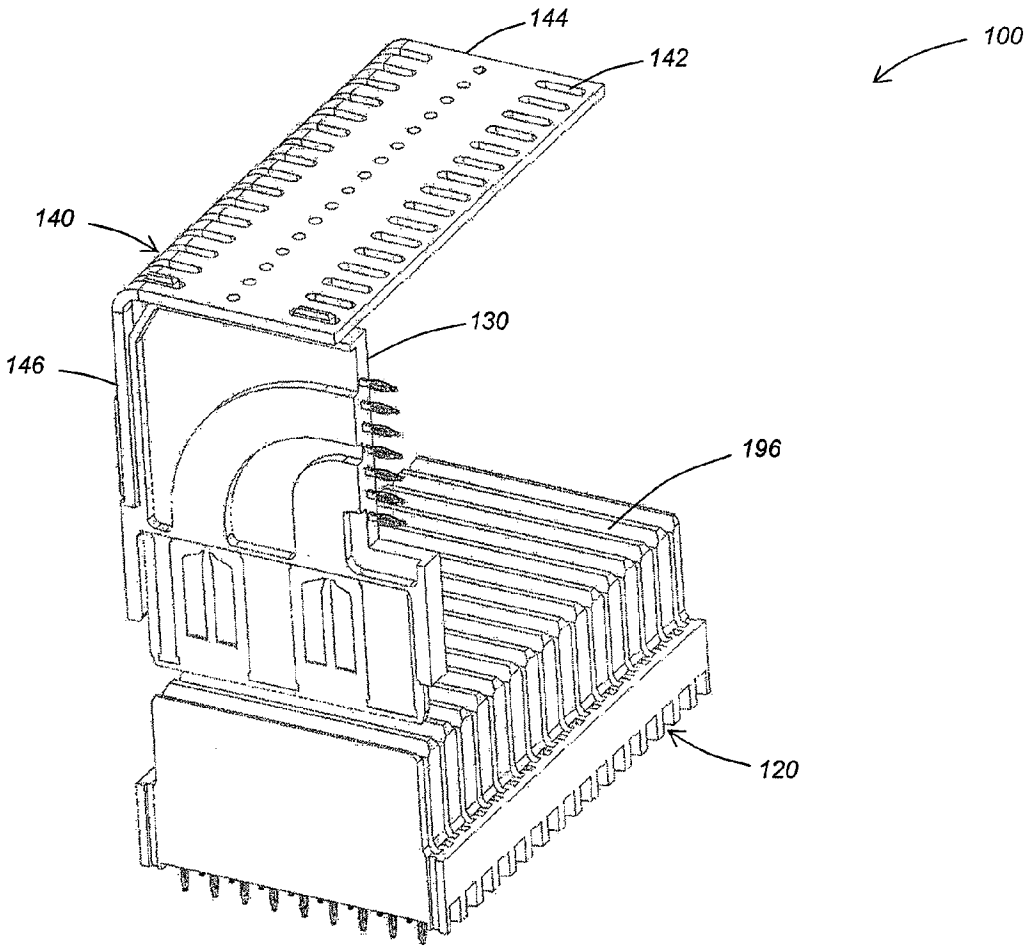
Figure 1C:
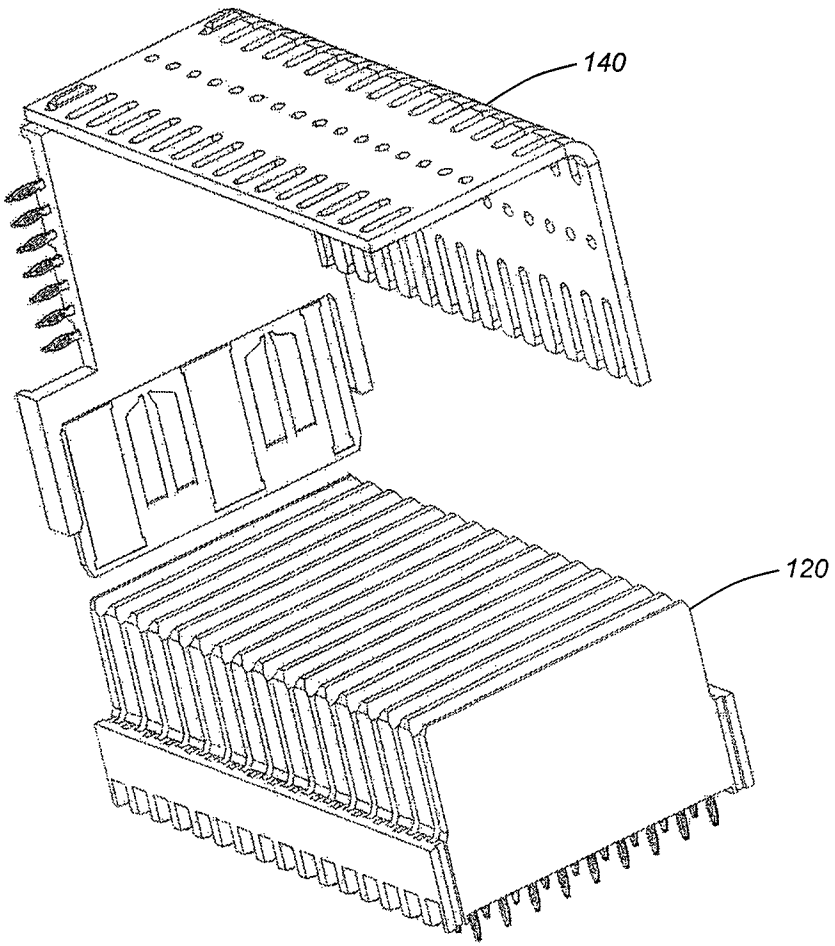

FIGS. 1*a*-1*c* disclose a connector assembly 100 that may be constructed using embodiments of the invention. In the embodiment illustrated, connector assembly 100 is configured as a right angle connector for mating a backplane and a daughterboard. However, the invention is not limited by the intended application and embodiments may be constructed for use as stacking connectors, mezzanine connectors, cable connectors, chip sockets or in any other suitable form. In the pictured embodiment, the connector assembly 100 includes a wafer assembly 110 that may be attached to a daughter board and a backplane connector 120 that may be attached to a backplane.

In the embodiment illustrated, wafer assembly 110 includes a plurality of individual wafers 130 supported by an organizer 140. The organizer 140 may be formed of any suitable material, including metal, a dielectric material or metal coated with a dielectric material. Organizer 140 includes a plurality of openings 142 corresponding to each wafer 130. The organizer 140 supports the wafers in a side-by-side configuration such that they are spaced substantially parallel to one another and form an array. The organizer 140 may include dielectric portions (not shown) that extend in the spaces between the wafers 130.

The array of wafers 130 define a board interface 150 for engaging the daughterboard (not shown), and a mating interface 152 for engaging the backplane connector 120 (FIG. 1*a*). The organizer 140 preferably includes first and second sections 144 and 146 forming an L-shape. However the organizer 140 may include only one of the first and second sections 144 and 146 or may have any other shape suitable for holding wafers in a desired position. In the embodiment illustrated, organizer 140 is constructed as a single member, but in some embodiments, two or more members may cooperate to form an organizer. In some embodiments, organizer 140 may be omitted and any suitable mechanism may be used to hold the wafers in an assembly.

The wafers 130 may contain projections or other attachment features that engage the organizer 140 via openings 142 (FIG. 1*b*) by any suitable attachment mechanism, including a snap engagement an interference fit or keyed segments. The openings 142 may be disposed in either or both of the first and second sections 144 and 146 of the organizer. Moreover, it is not crucial to the invention that organizer 140 include openings to receive features from wafers 130 because any suitable attachment mechanism may be used, including having projections from organizer 140 engage wafers 130.

Figure 1D:
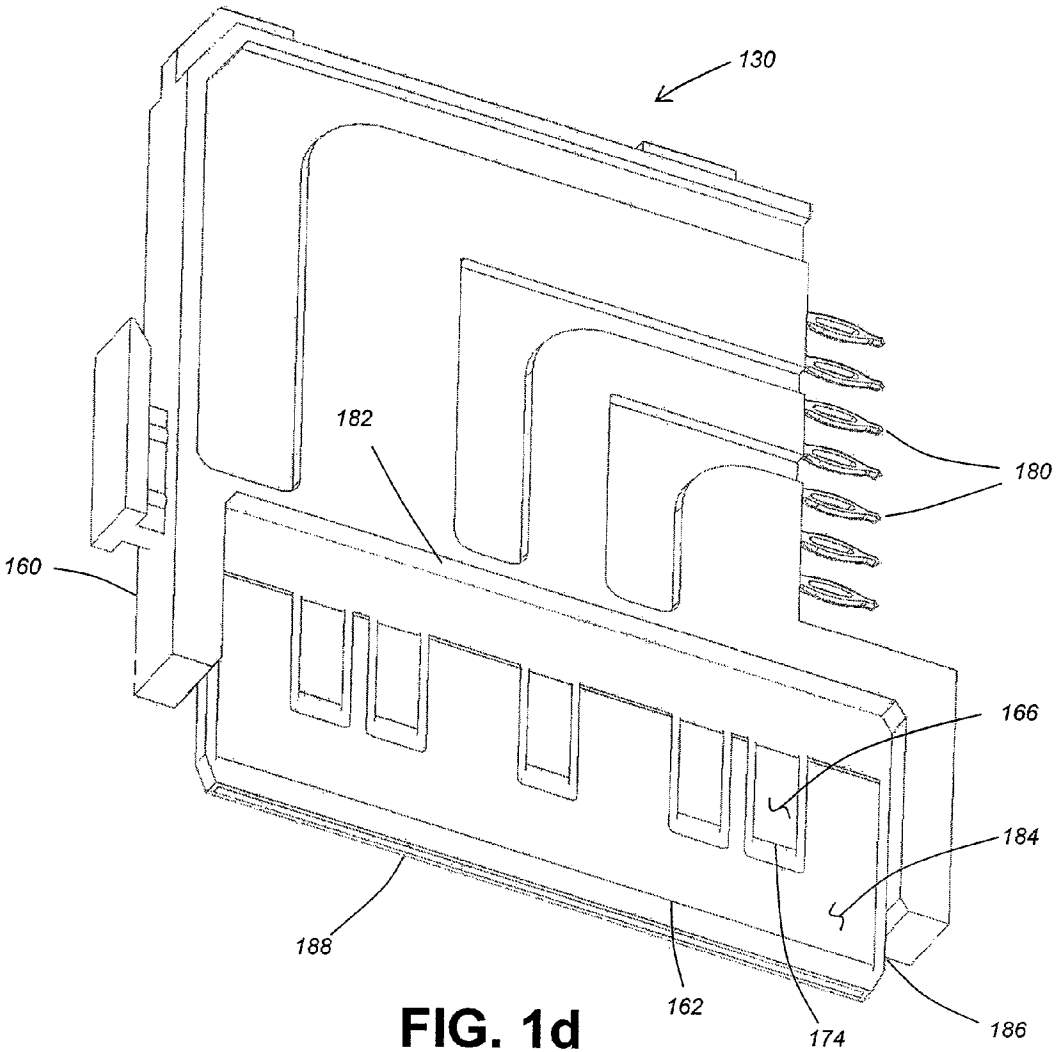
FIG. 1*d* illustrates a wafer that may be used in a connector assembly according to an embodiment of the invention.
Figure 1E:
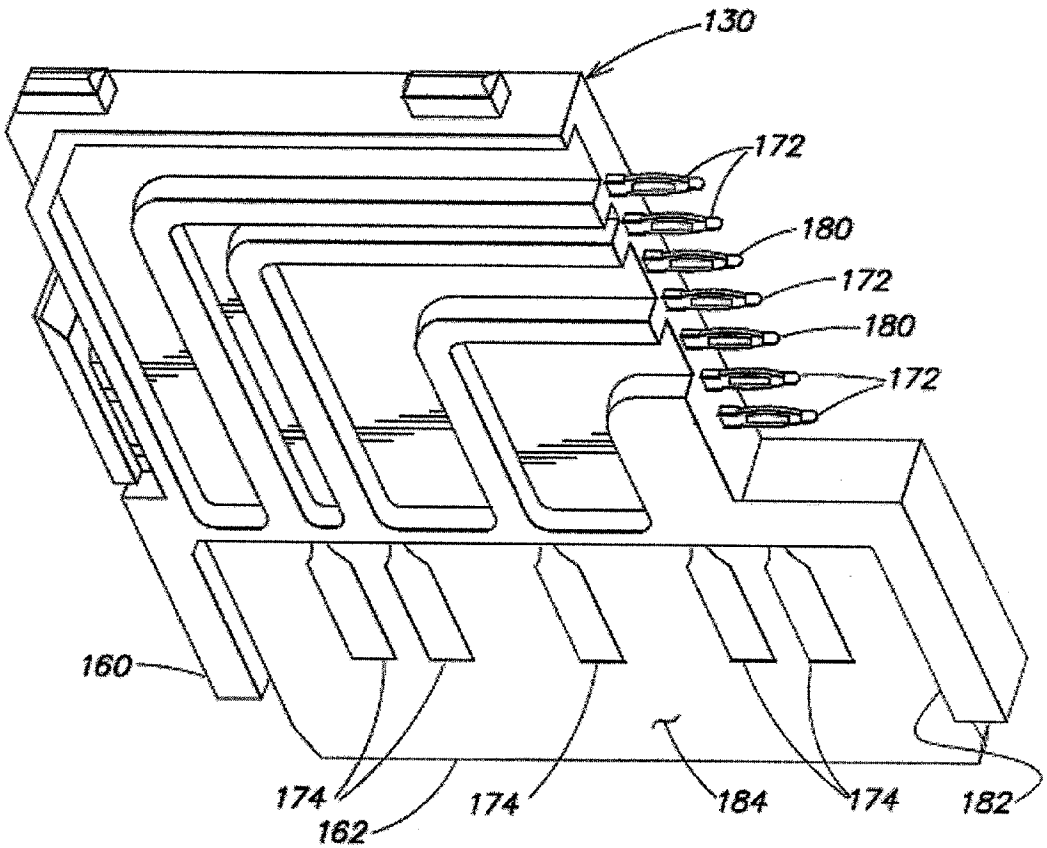
FIG. 1*e* illustrates a wafer that may be used in a connector assembly according to an embodiment of the invention.

FIG. 1*d* shows a wafer 130 according to an embodiment of the invention that may be used in a wafer assembly 110. Each wafer 130 (FIG. 1*d*) includes a housing 160 supporting one or more conductive elements. The conductive elements may be shaped and positioned to conduct signals and reference potentials. In the embodiment illustrated, signal conductors and reference conductors have different shapes. The signal conductors may be positioned to carry differential signals and/or single-ended signals. In the embodiment of FIG. 1*d*, wafer 130 is configured to carry two differential signals and one single-ended signal.

Each signal conductor may have a contact tail designed to be attached to a printed circuit board. In the embodiment of FIG. 1*d*, the contact tails are in the form of press-fit contacts forming terminals 172. However, any suitable contact tail may be used, including posts, surface mount J-leads, through-hole leads or BGA pads. Terminals 172 may have compliant segments that may be compressed to fit in a conductive via in a printed circuit board or other substrate. Once inserted in the via, the compliant member exerts an outward force to make electrical contact to the via and to provide mechanical attachment of wafer 130 to the board. In some embodiments, the mechanical attachment provided by terminals of wafer 130 may adequately secure wafer 130. In other embodiments, additional mechanical attachment structures may be used.

Each signal conductor also has a mating contact portion, adapted to make connection to a conductive element within blackplane connector 120. In the embodiment of FIG. 1*d*, each mating contact portion is shaped as a conductive pad, illustrated as a terminal 174. In this embodiment, terminals 174 provide pads against which one or more compliant segments from a mating contact may press to make electrical connection between wafer assembly 110 and a backplane connector 120. However, wafer 130 may have any suitable form of mating contact portion.

Each signal conductor also includes an intermediate portion, joining the first terminal 172 to the second terminal 174. The intermediate portion forms a signal track 166 through the wafer. In this way, signals may be transmitted from a circuit card, through the wafer 130 to a backplane connector 120, which in turn may be connected to conductive traces in a backplane (not shown).

Each wafer 130 may also include one or more reference potential conductors. In the embodiment of FIG. 1*d*, each wafer includes a single reference potential conductor that has a generally planar shape. In the embodiment illustrated, the reference potential conductor includes contact tails and mating contact portions. The contact tails may also be in the form of press fit contacts forming ground terminals 180. However, any suitable mechanism may be used to attach the reference potential conductors to a printed circuit board or other substrate. In the embodiment illustrated, the mating contact portions of the reference potential conductors are also in the form of pads against which a beam or other compliant member from a mating contact in backplane connector 120 may press to form an electrical connection. In the embodiment illustrated, the mating contact portions are formed by exposed surface areas 184 of the reference potential conductor.

In the embodiment of FIGS. 1*a*-1*g*, each wafer assembly includes a generally planar reference potential conductor that runs parallel to the signal conductors. In this configuration, the reference potential conductor may act as a shield 162 that reduces cross-talk between signal conductors in adjacent wafers 130 of wafer assembly 110. Additionally, configuring a signal track parallel to such a shield member may form a micro strip transmission line, having desirable electrical properties, including a controlled impedance and few discontinuities that could create signal reflections.

To provide a desirable spacing between signal tracks and a corresponding shield, the signal conductors and reference potential conductors may be held within a housing 160. Wafer 130, for example, may be formed by insert molding conductive elements in housing 160. In such an embodiment, housing 160 may be an insulative material, such as a plastic or nylon. However, any suitable material may be used to form housing 160.

Each shield 162 includes ground terminals 180 separate from the signal tracks 166 and formed integrally with the shields, such that the shields and ground terminals 180 form a unitary, one-piece member. The ground terminals 180 extend from each shield at board interface 150 for engagement with the daughterboard, such as by a press-fit. Because the ground terminals 180 are formed integrally with shield 162, a separate connection is not required between the ground terminals 180 and the shields, which may reduce manufacturing costs and provide a more robust connector.

Each wafer housing 160 may substantially encapsulate shield 162. Though, in some embodiments, only a portion of shield 162 may be embedded in housing 160. In yet further embodiments, other mechanisms may be used to hold a shield in a wafer, such as by snapping or otherwise attaching shield 162 to housing 160.

In the embodiment illustrated, each housing 160 includes a cutout portion 182 that forms a mating segment. Cutout portion 182 exposes the second end terminals or pads 174 of the signal tracks 166 for connection with the backplane connector 120. Surface areas 184 (FIG. 1*d*) of the shield around the pads 174 are also exposed and provide a ground connection.

Shield 162 may extend to edge 186 of the housing 160 to form a ground plane extension 188. When the wafers 130 are held in a wafer organizer 140 to create a wafer assembly 110, ground plane extensions 188 of the individual wafers will be exposed at mating interface 152. If any object that has a static charge on it comes into contact with mating interface 152, that static charge will be conducted through the ground plane extensions 188, through shields 162, through terminals 180 into the ground system of a printed circuit board to which wafer assembly 110 is attached. Because terminals 174, which may be connected to signal generating devices on a daughter board, are not exposed at mating interface 152, the possibility that static electricity will be discharged through the signal conductors is significantly reduced. Avoiding discharge of static electricity through the signal conductors may be desirable because static electricity discharged through a signal conductor may create a damaging voltage on an electronic component on a daughtercard to which wafer assembly 110 is attached.

Figure 1F:
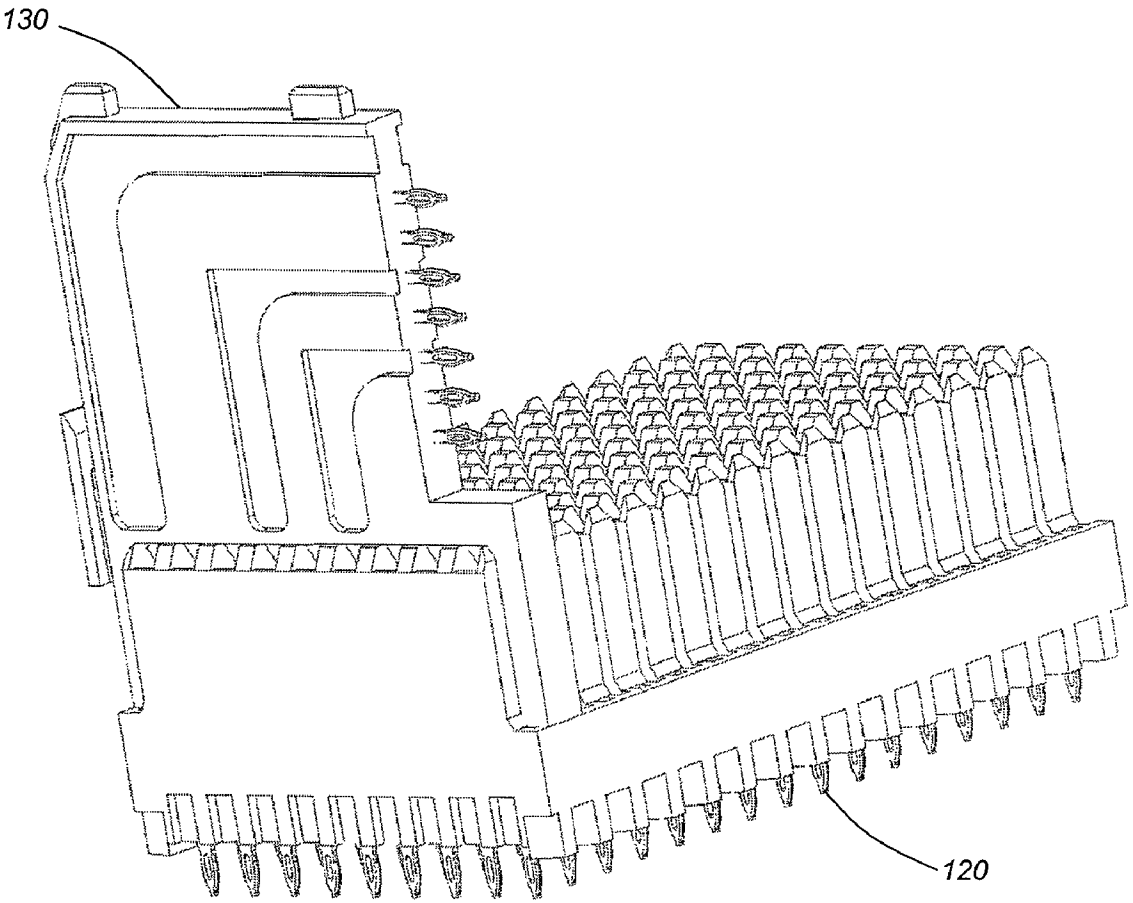
FIGS. 1*f* and 1*g* illustrate mating of conductive elements in a wafer and a backplane connector according to an embodiment of the invention.
Figure 1G:
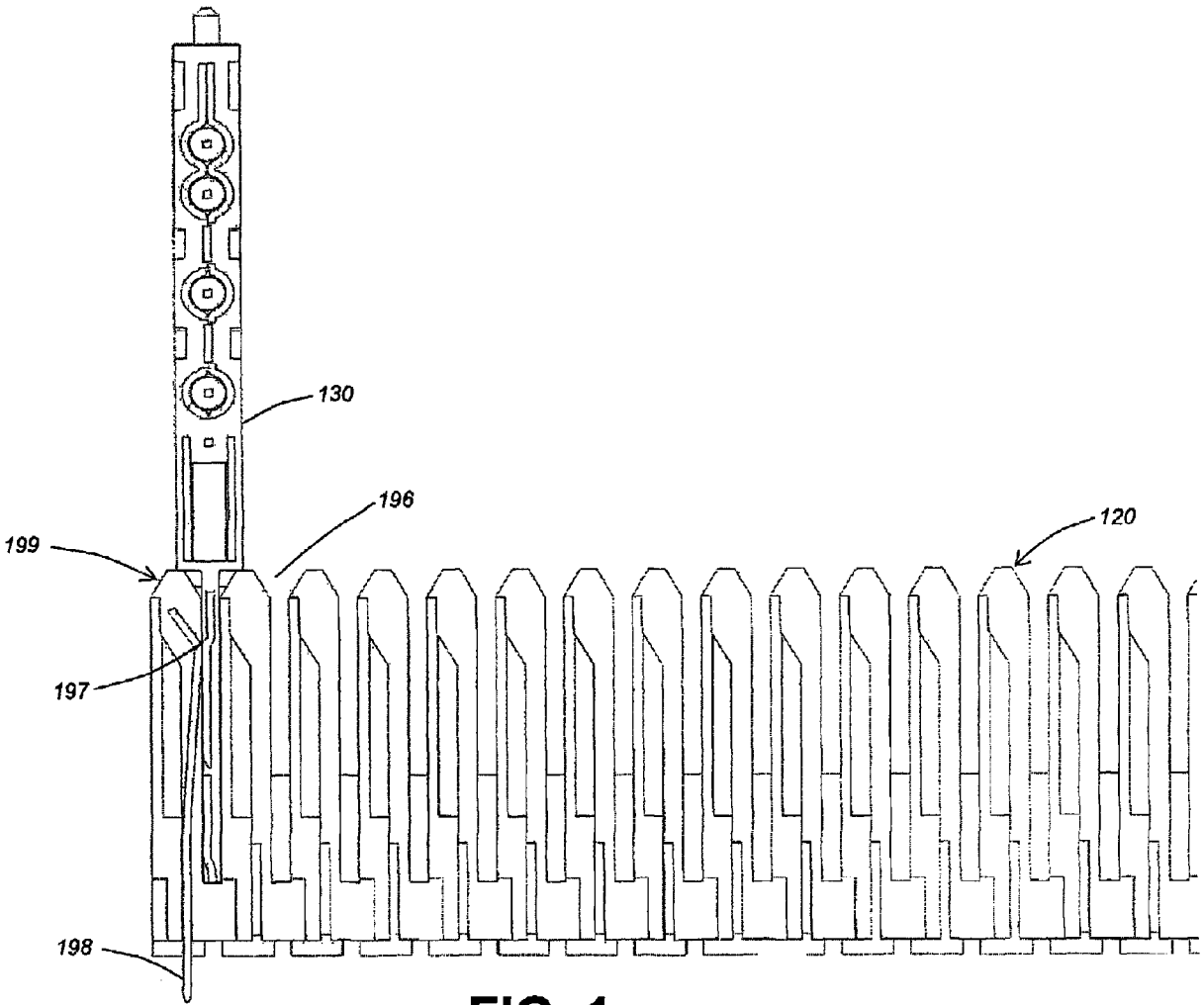

FIGS. 1*f* and 1*g* illustrate mating of conductive elements within a wafer assembly 110 to conductive elements within a backplane connector 120. The backplane connector 120 includes a housing 192 with a mating interface 194 for engaging the mating interface 152 of the array of wafers 130 (FIG. 1*a*). The housing 192 includes an array of slots 196 for receiving corresponding individual wafers 130. In the embodiment illustrated, each slot 196 receives a cutout portion 182 of a corresponding wafer 130.

A plurality of conductive elements may be positioned along each slot 196. Each conductive element may have a mating contact portion, adapted to mate with a conductive element within wafer assembly 110 when wafer assembly 110 is mated with backplane connector 120. In the embodiment illustrated, the conductive elements of backplane connector 120 include signal conductors positioned and shaped to mate with the signal conductors in wafer assembly 110 and ground conductors positioned and shaped to mate with the ground conductors in wafer assembly 110.

In the embodiment illustrated, each conductive element in backplane connector 120 has a contact tail extending from housing 192 for attachment to a printed circuit board or other substrate, such as a backplane. The conductive elements in backplane 120 may be in any suitable form. In the embodiment illustrated, the signal conductors and the ground conductors have different shapes. The signal conductors are in the form of elongated beams, with each signal conductor having multiple beams to provide multiple points of contact with a terminal 174. The ground conductors are in the form of opposing compliant segments that form a slot adapted to receive an exposed portion of a shield 162. However, any suitable size or shape of mating contact portion may be used.

In the embodiment illustrated in FIG. 1*g*, a signal contact 198 within backplane connector 120 is illustrated with a hook-shaped end 199. Hook-shaped end 199 is adapted to be retained within housing 192, while allowing contact surface 197 to extend into a slot 196 to make contact with a mating contact portion of a conductor from a wafer 130. This configuration may be desirable to reduce stubbing upon insertion of a wafer 130 into a slot 196.

Figure 1H:
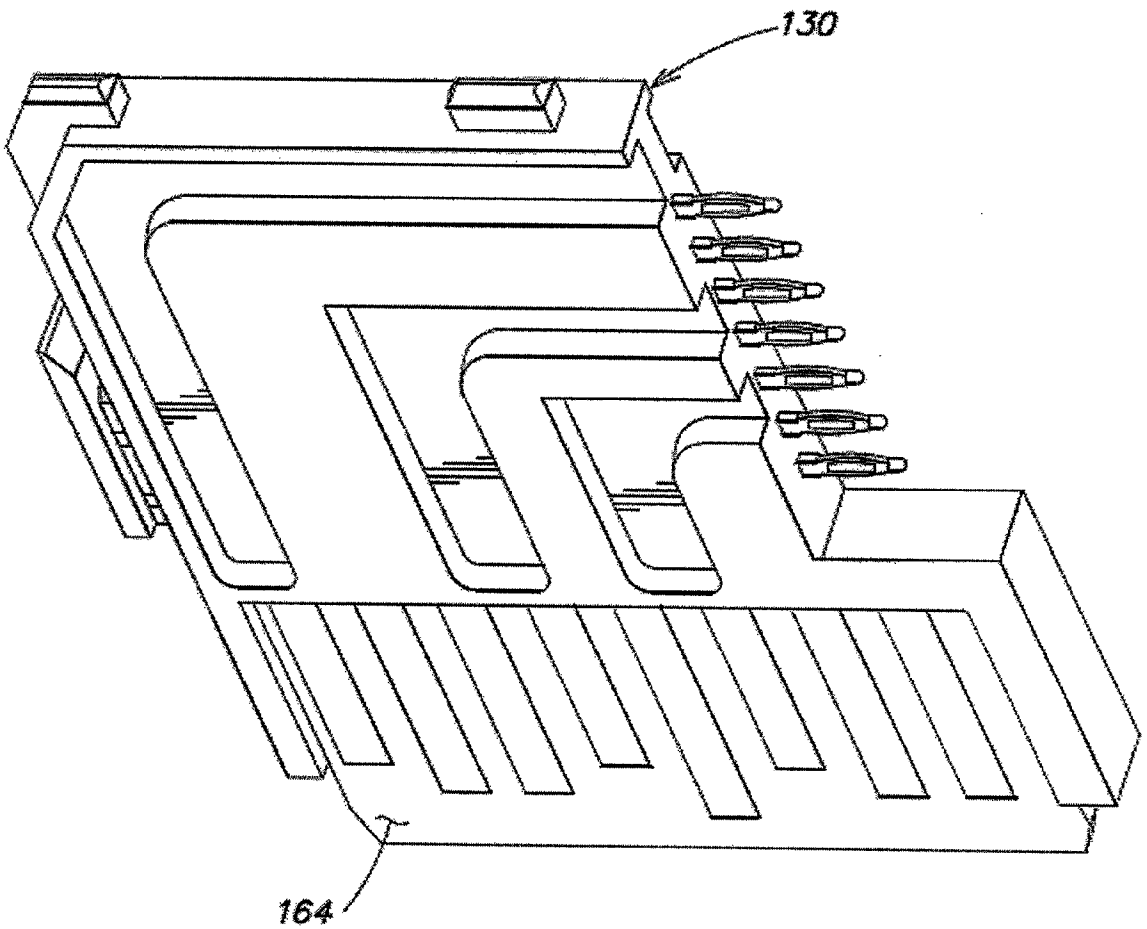
FIG. 1*h* illustrates a wafer according to an alternative embodiment of the invention.

FIG. 1*h* illustrates an alternative embodiment of a wafer 130. In the embodiment of FIG. 1*h*, wafer 130 has a different number of signal conductors than the embodiment illustrated in FIG. 1*d*. However, the number and positioning of signal conductors is not a limitation on the invention, and a wafer of any number of signal conductors may be constructed according to embodiments of the invention.

Figure 1I:
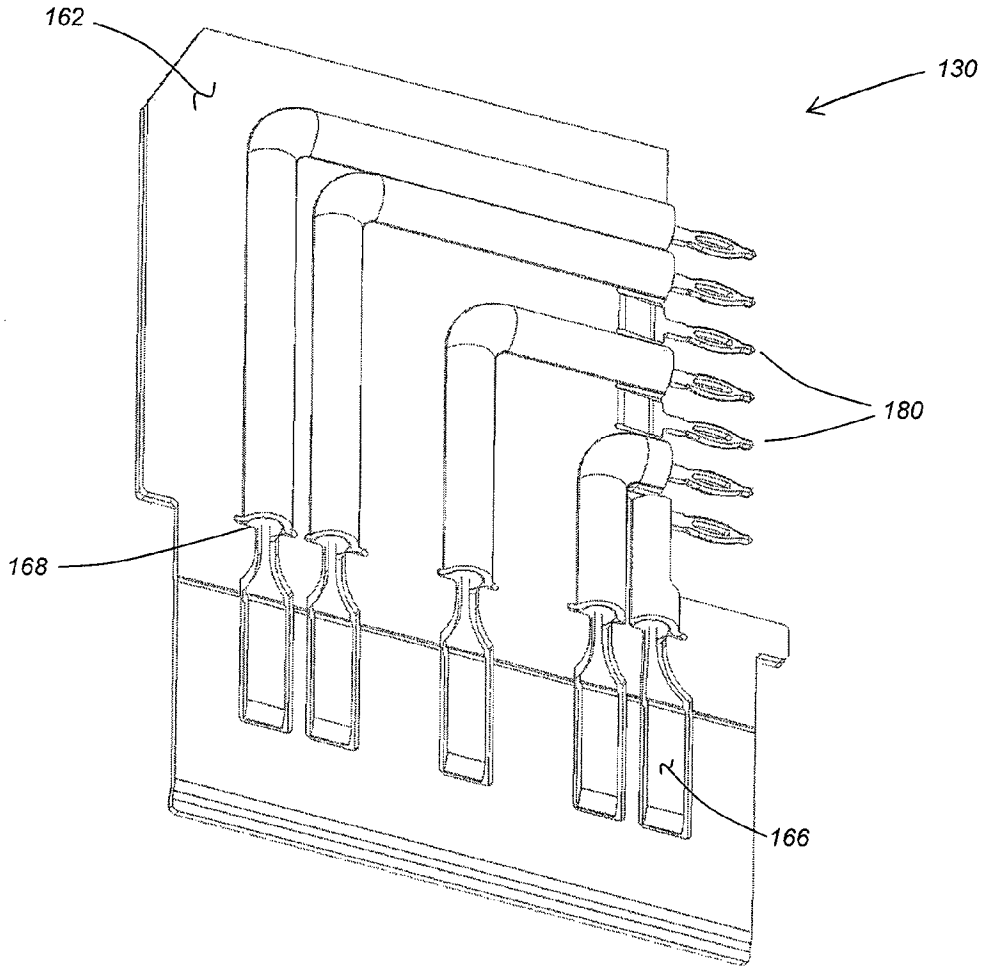
FIGS. 1*i* and 1*j* illustrate construction of a wafer according to an alternative embodiment of the invention.
Figure 1J:
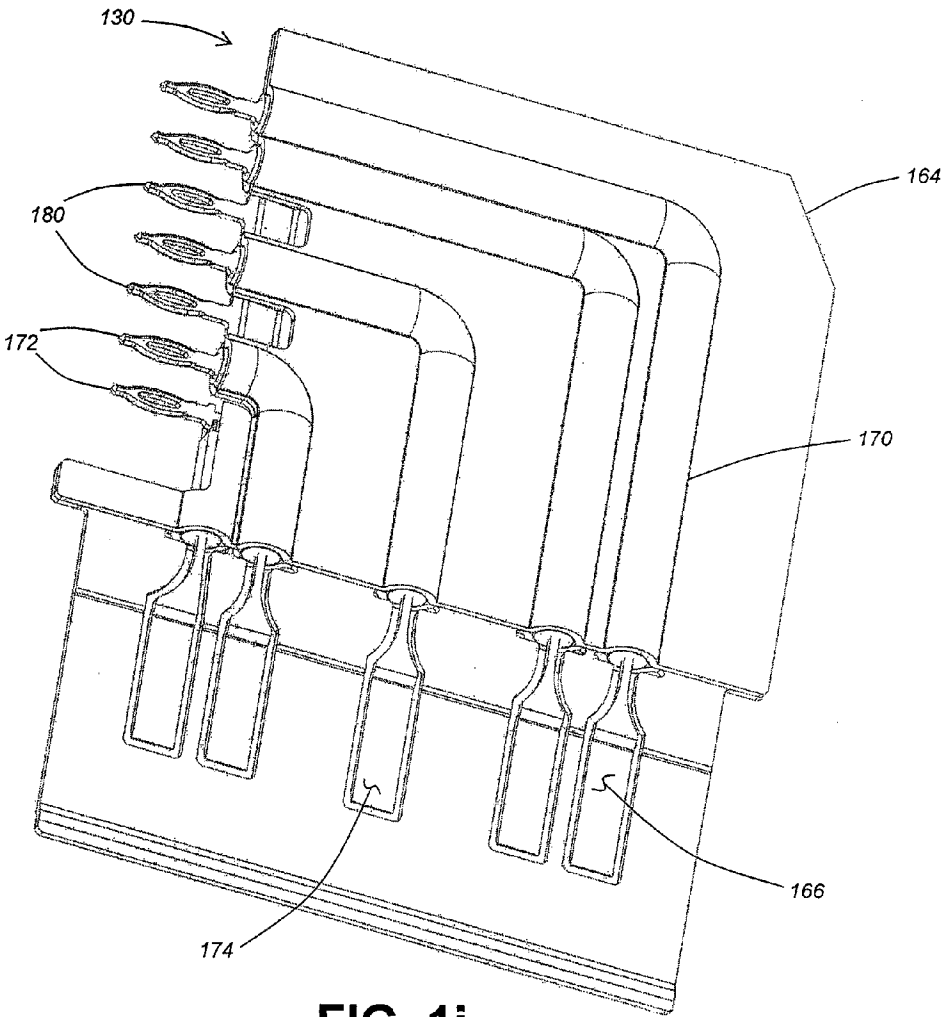

FIGS. 1*i* and 1*j* illustrate an alternative approach for constructing a wafer 130. In the embodiment illustrated, two shield members may be used. Each shield may be formed with one or more contact tails adapted to engage a printed circuit board. Each shield also may include a mating contact portion. The shields may be formed to include channels 168 into which signal tracks 166 may be placed. Signal tracks 166 may have the same shape as in the embodiment of FIG. 1*d*, including contact tails for engagement to a printed circuit board and a mating interface for mating to corresponding signal conductors in a backplane connector. As shown, each signal track 166 includes opposite first and second terminals 172 and 174 at its ends. The first terminal 172 of each signal track 166 may be a press-fit pin at the first mating interface 150, and the second terminal 174 may be a pad at the second mating interface 152.

When the wafer is assembled, signal tracks 166 are sandwiched between channels 168 formed in the shields 162 and 164 (FIGS. 1*i* and 1*j*). Surrounding each signal track is insulation 170 that may substantially fill the channels 168 of the shields 162 and 164. In the embodiment illustrated, the insulation is in the form of a plastic or other moldable material, though some or all of the insulation may be air or other suitable material.

FIGS. 2*a*-2*l* illustrate a second exemplary embodiment of the present invention, including a connector assembly 200 with a wafer assembly 210 and a backplane connector 220. Similar to wafer assembly 110 of above described embodiments, wafer assembly 210 includes an array of wafers 230 and an organizer 240. Wafer assembly 210 has a board interface 250 and a second mating interface 252.

Figure 2A:
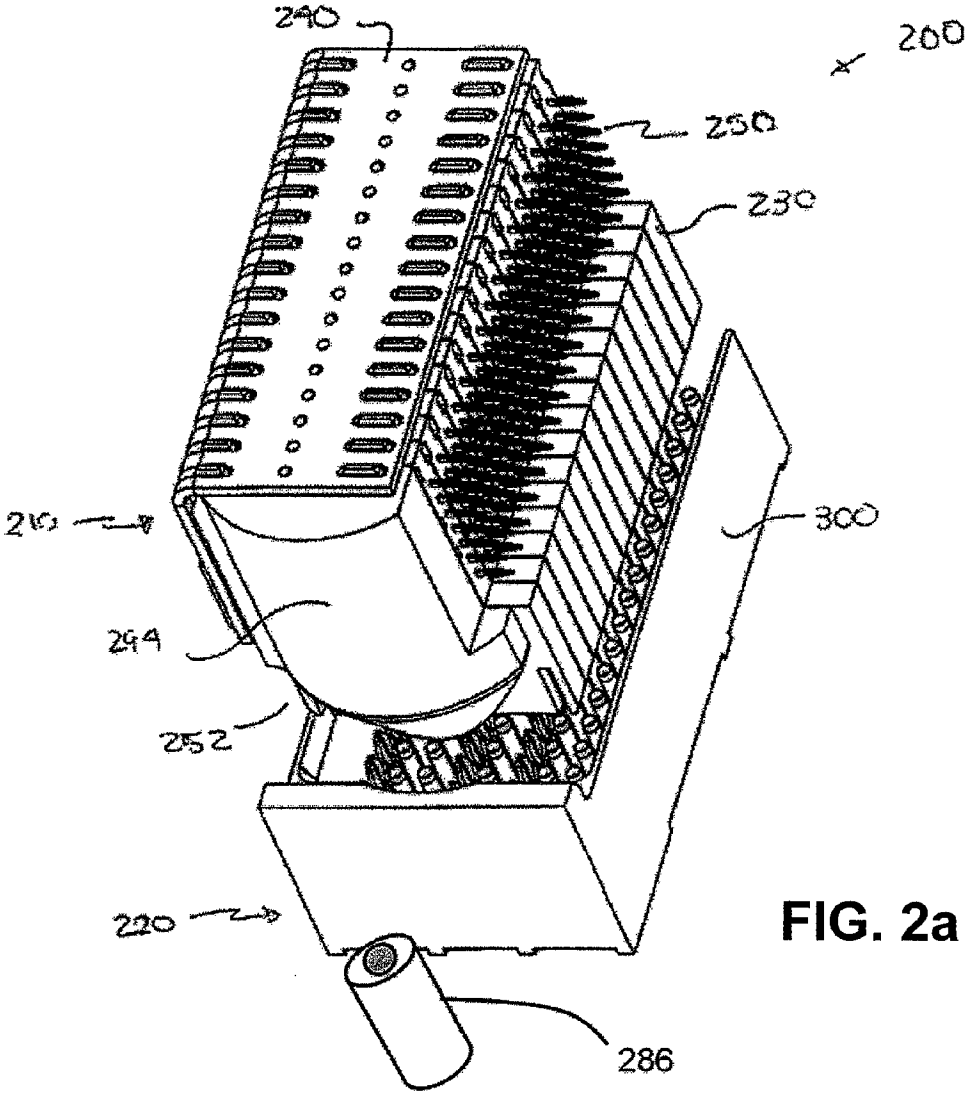
FIGS. 2*a*-2*d* illustrate another exemplary embodiment of a connector assembly in accordance with the present invention.
Figure 2B:
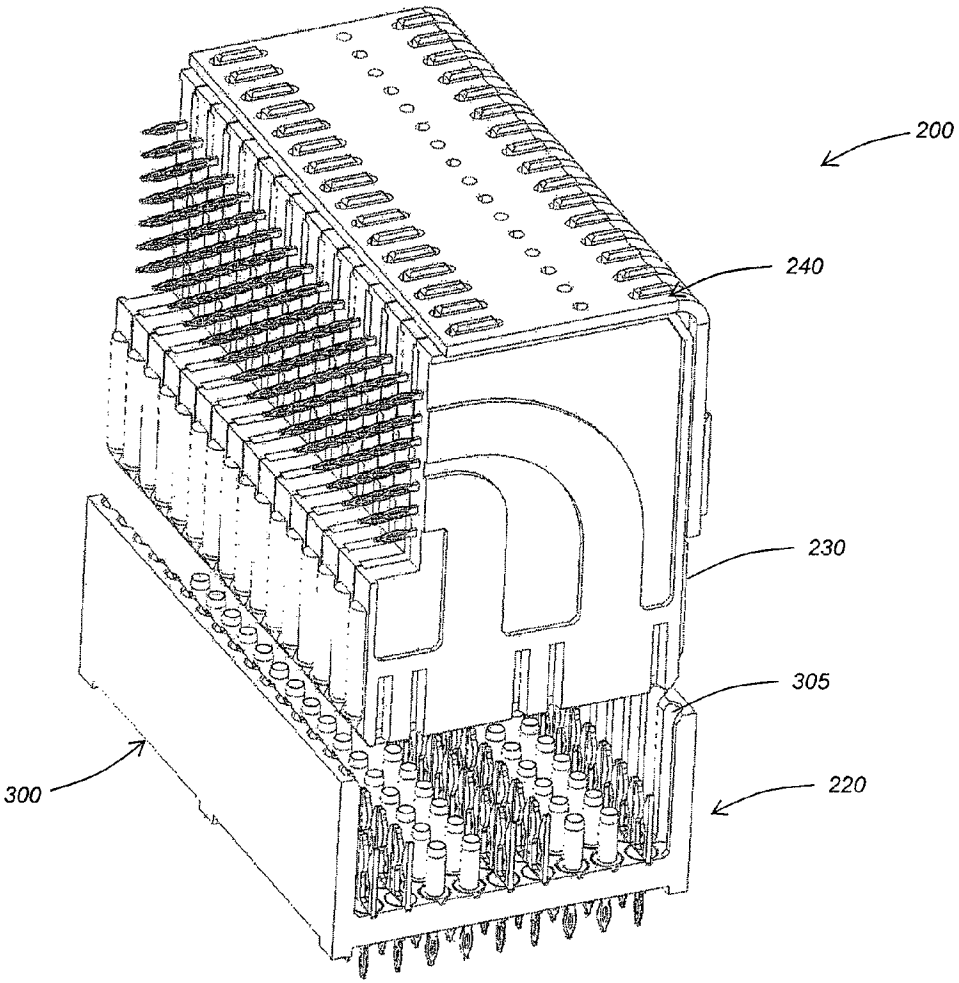
Figure 2C:
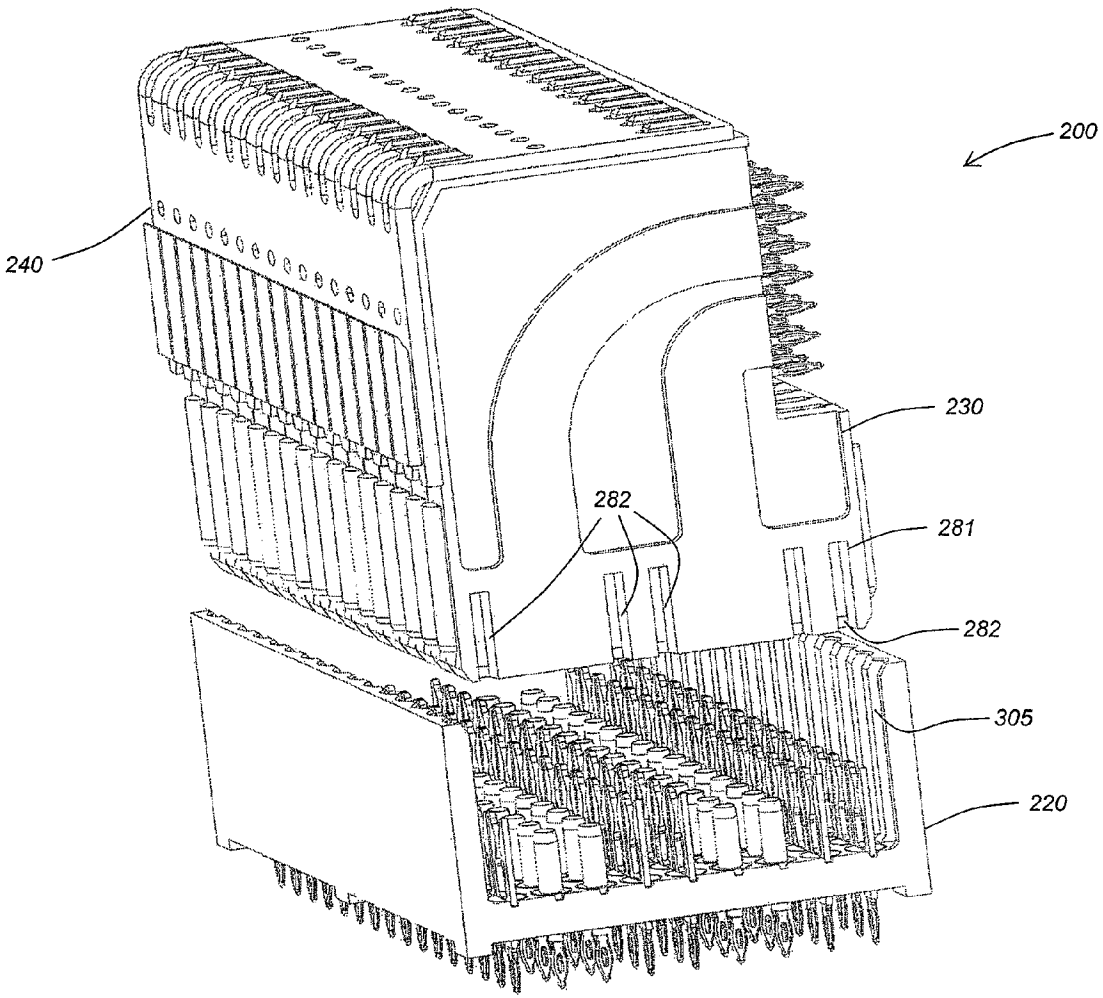
Figure 2D:
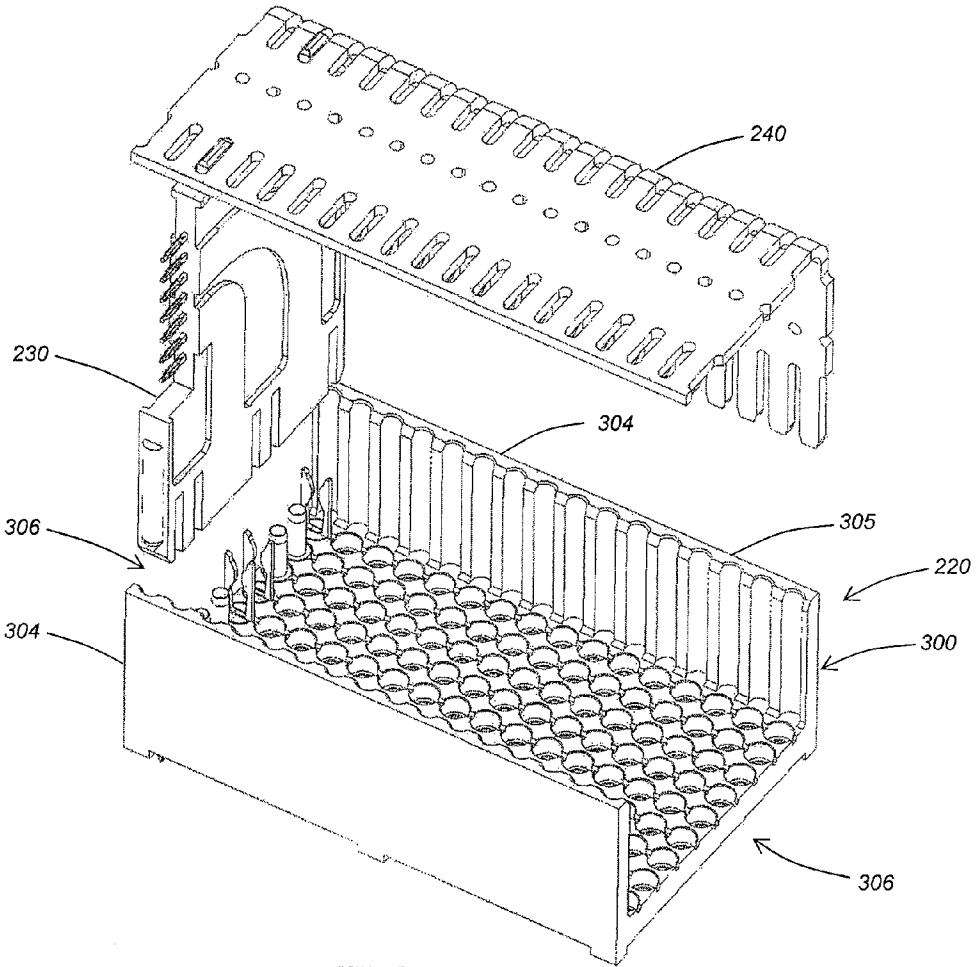
Figure 2E:
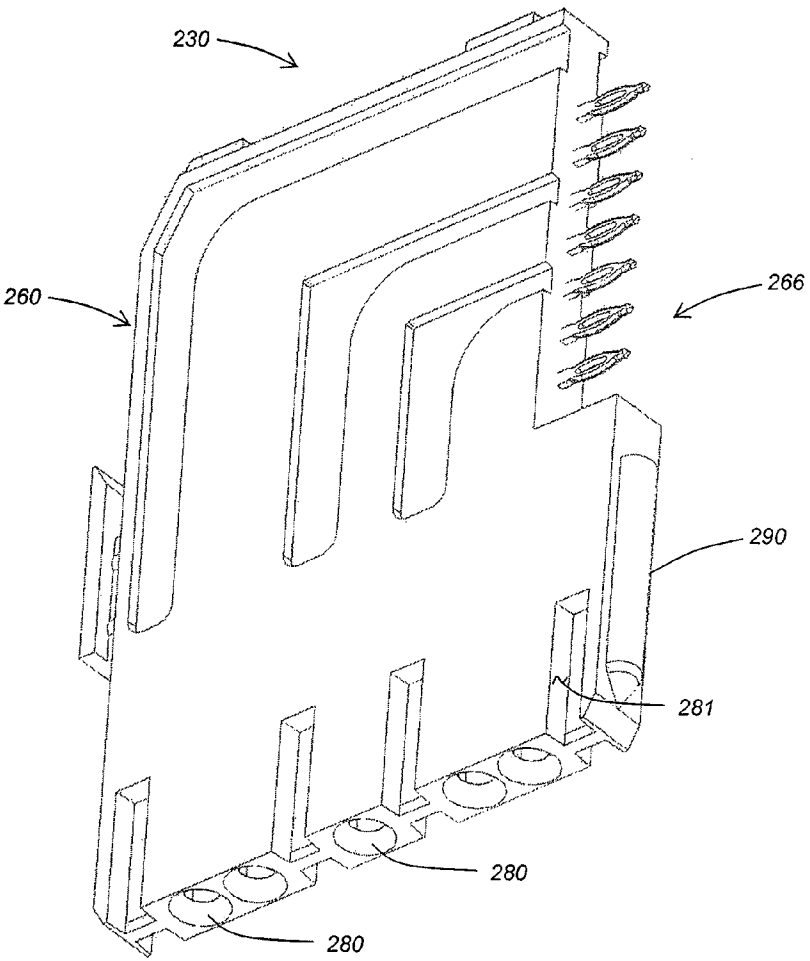
FIG. 2*e* illustrates a wafer that may be used in a connector assembly of FIGS. 2*a*-2*d;*
Figure 2F:
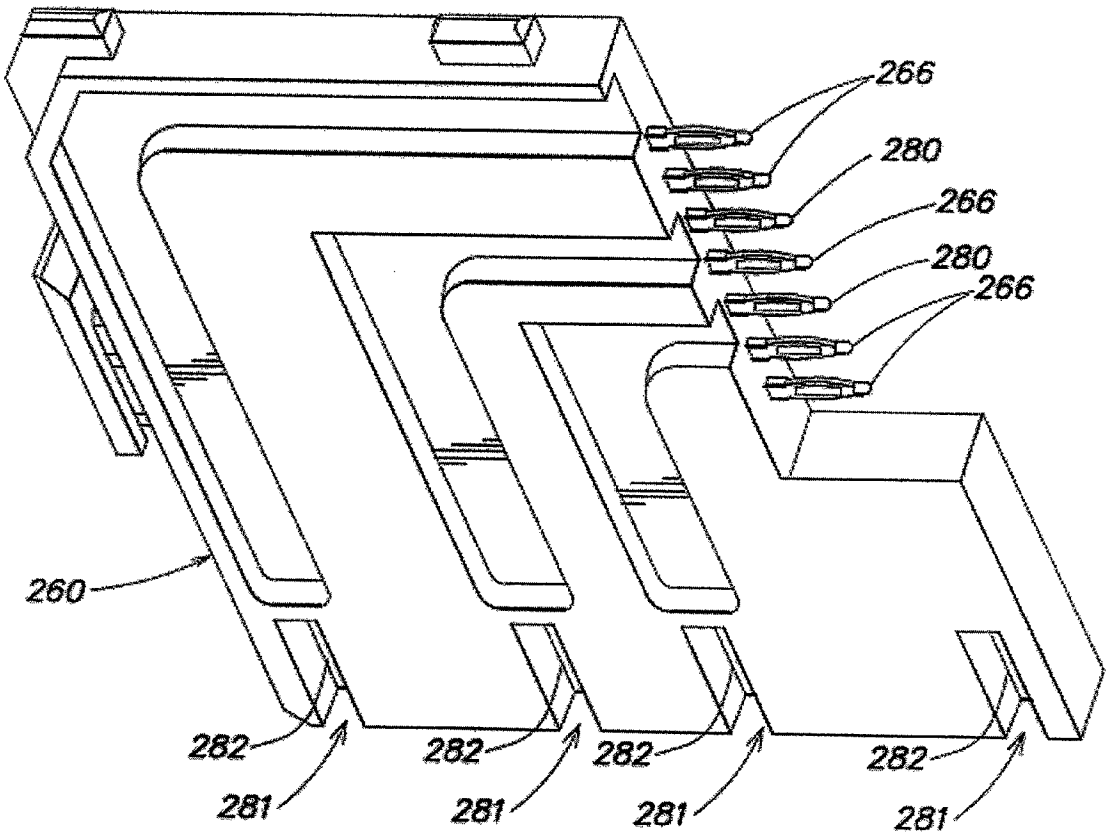
FIG. 2*f* is a sketch of a wafer that may be used in a connector assembly of connectors 2*a*-2*d* according to an alternative embodiment of the invention.
Figure 2G:
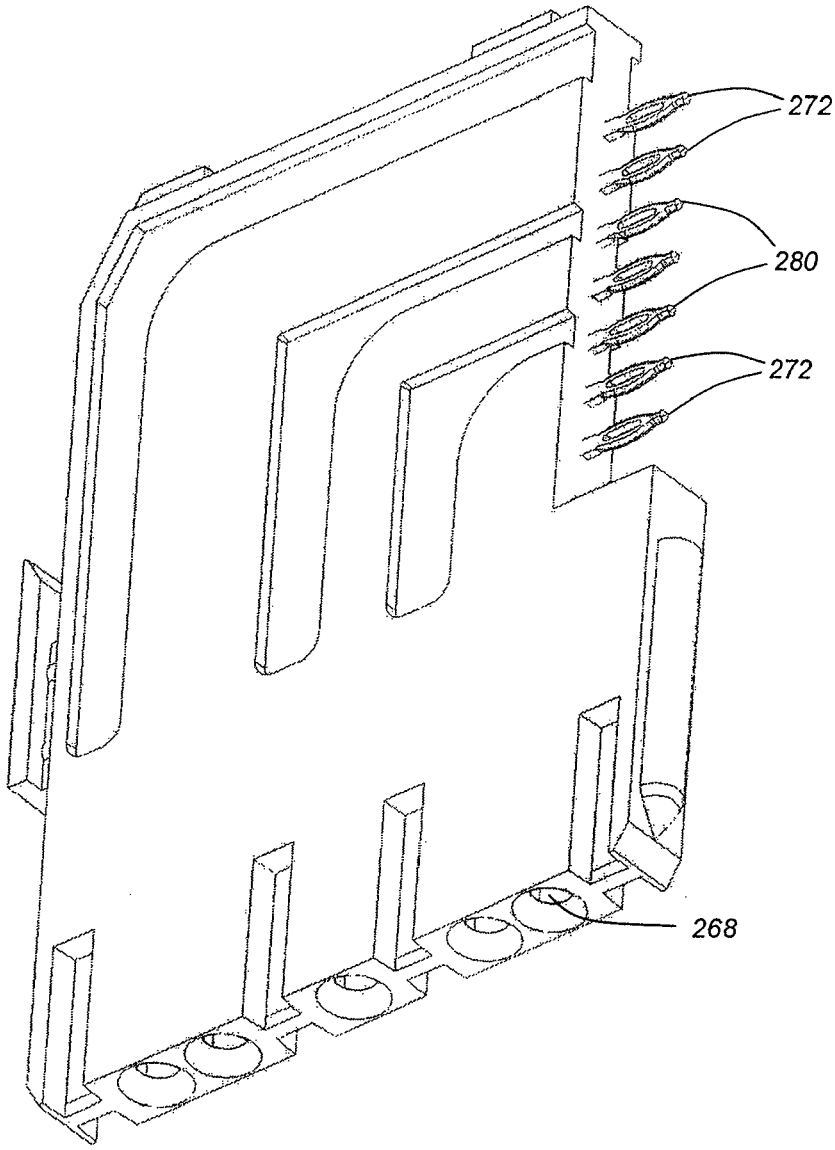
FIGS. 2*g* and 2*h* illustrate construction of a wafer that may be used in connector assembly of FIGS. 2*a*-2*d* according to an alternative embodiment of the invention.
Figure 2H:
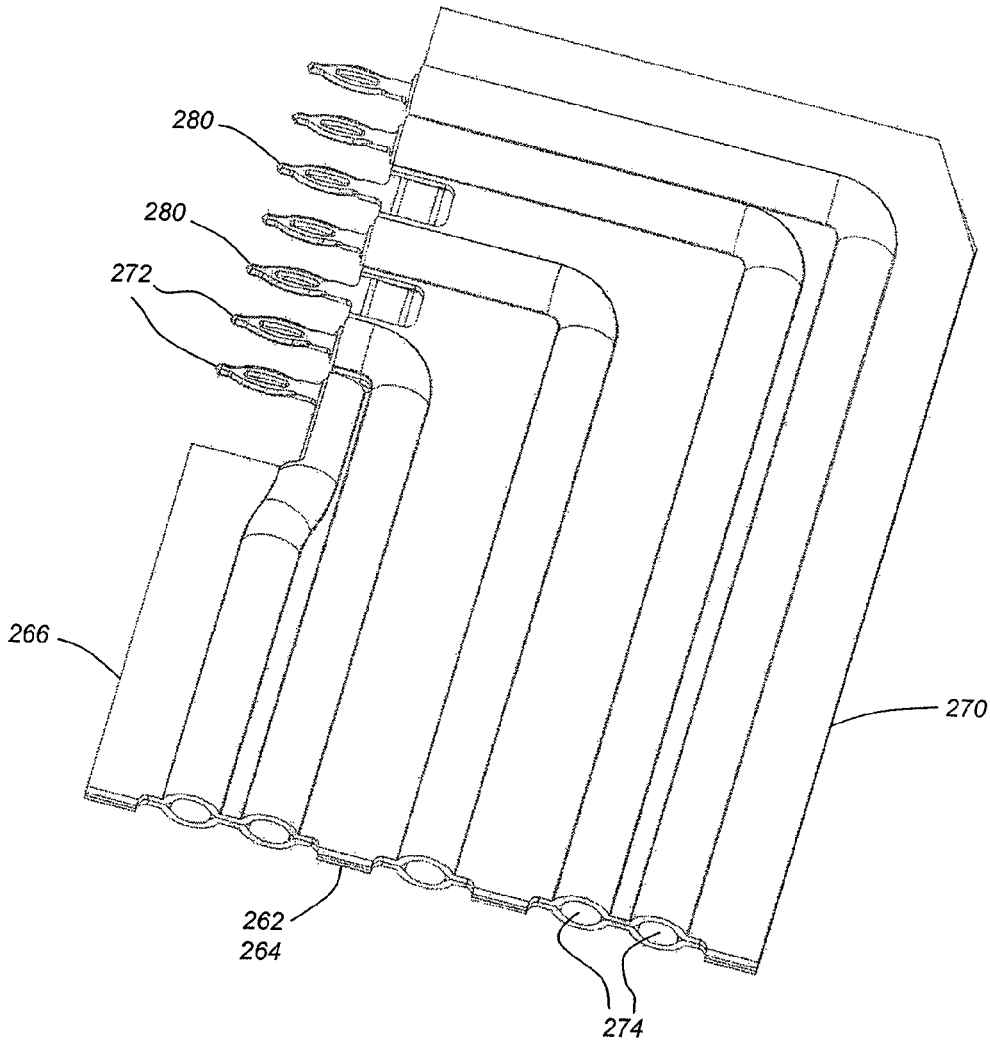
Figure 2I:
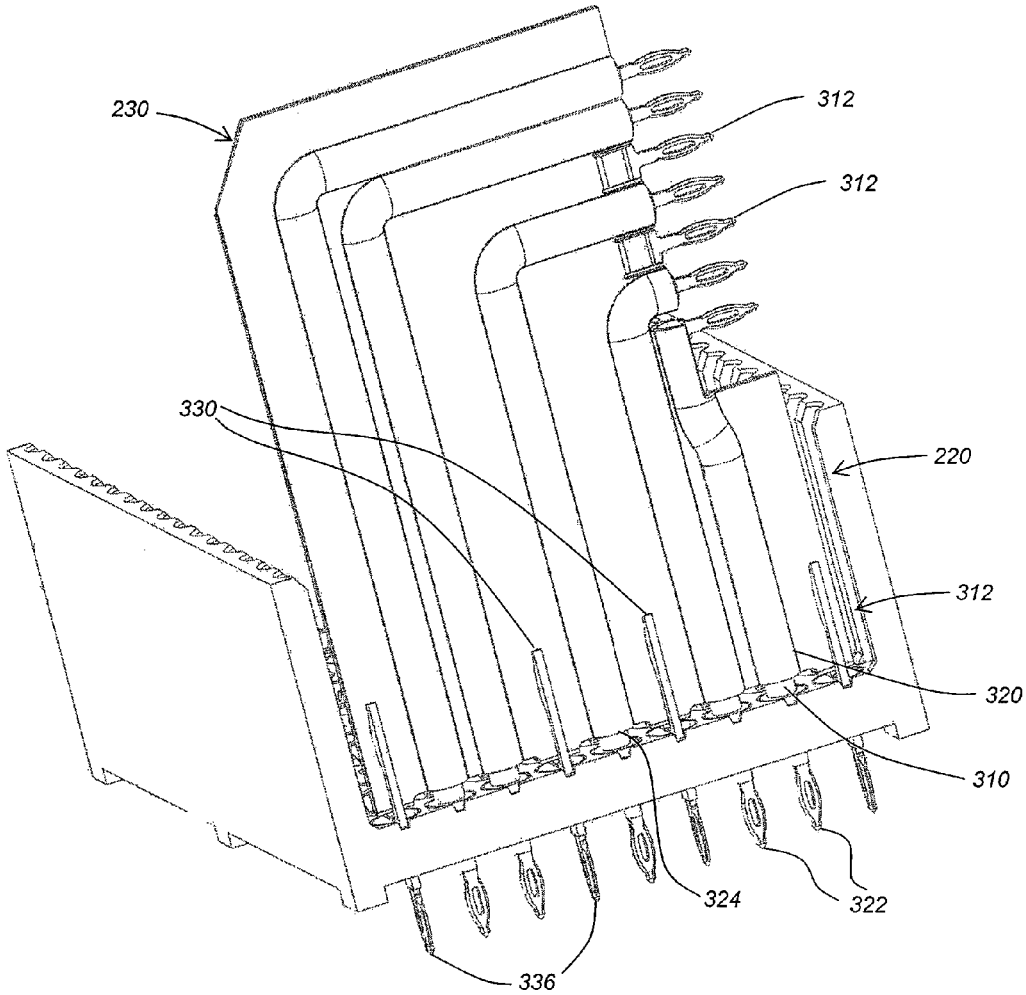
FIGS. 2*i* and 2*j* illustrate mating of a wafer to a backplane connector in the connector assembly of FIGS. 2*a*-2*d;*

Each wafer 230 of the second embodiment includes a housing 260 supporting first and second conductive shields 262 and 264. Signal tracks 266 are sandwiched between channels 268 formed in the shields 262 and 264 (FIGS. 2*g* and 2*h*). Surrounding each signal track may be insulation 270, which may substantially fill the channels 268 of the shields 262 and 264. Molding or other suitable operation may be used to position insulation 270 after signal tracks 266 have been positioned in the recesses. Insulation 270 may be molded around signal tracks 260 before insertion into the channels or after insertion. However, the invention is not limited to embodiments in which insulation fills the channels, spacers or other suitable mechanisms may be used to electrically isolate tracks 266 from shields 262 or 264.

Each signal track 266 includes opposite first and second terminals 272 and 274 at its ends adapted to form a contact tail for attachment to a printed circuit board or other substrate and a mating contact portion for mating to a corresponding conductive element in a mating connector. The first terminal 272 of each signal track 266 may be a press fit pin at the first mating interface 250.

Unlike embodiments in which mating contact portions were illustrated as pads, wafer 230 is illustrated with signal conductors having mating contact portions that may be shaped as pins or other structures that fit within channels 268. However, terminals 274 may have any suitable shape. Complimentary mating contact portions may be included on signal conductors within backplane connector 220. To receive a mating contact portion in the shape of a pin from a wafer 230, the mating contact portion in backplane connector 220 may be in the form of a receptacle. The receptacle may be surrounded by insulating material to preclude electrical connection between the mating contact portion of a signal conductor in backplane connector 220 and a shield 262 or 264. However, any suitable contact configuration may be used for mating contact portions within backplane connector 220, including using a post within backplane connector 220 and a receptacle at an end of a signal track 266 within the wafer.

Each shield 262 and 264 includes ground terminals 280 separate from the signal tracks 266 and formed integrally with the shields, such that the shields and ground terminals 280 form a unitary, one-piece member (FIGS. 2*g*, 2*h*). The ground terminals 280 extend from each shield at the first mating interface 250 for engagement with the daughterboard, such as by press-fit.

A housing 260 may encapsulate the shields 262 and 264 and may include a plurality of vertical slots 281 (FIG. 2*f*) exposing select portions of the shield to provide ground contact areas 282. However, any suitable mechanism may be used to hold the shields 262 and 264 together. Housing 260 may be formed of any suitable material and, for example, may be a molded dielectric material, such as plastic or nylon. Though, in some embodiments, housing 260 may be conductive or partially conductive. An end of the housing 260 at the second mating interface 252 includes openings 284 corresponding to the ends of the signals 266, thereby defining receptacles for receiving corresponding mating contacts of the backplane connector 220. The housing 260 may also include a guide portion 290 (FIG. 2*e*) extending from the housing 260 to engage a corresponding slot of the backplane connector 220.

Figure 2J:
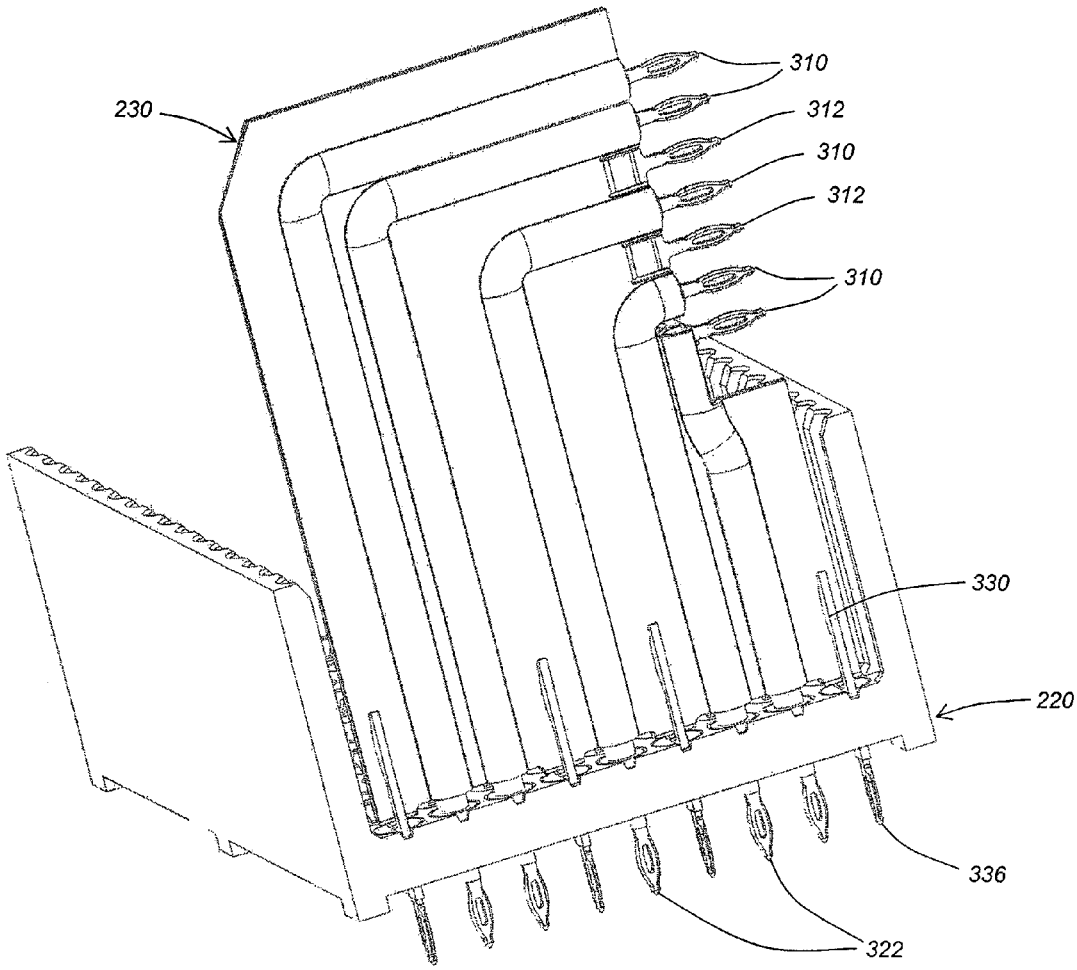
Figure 2K:
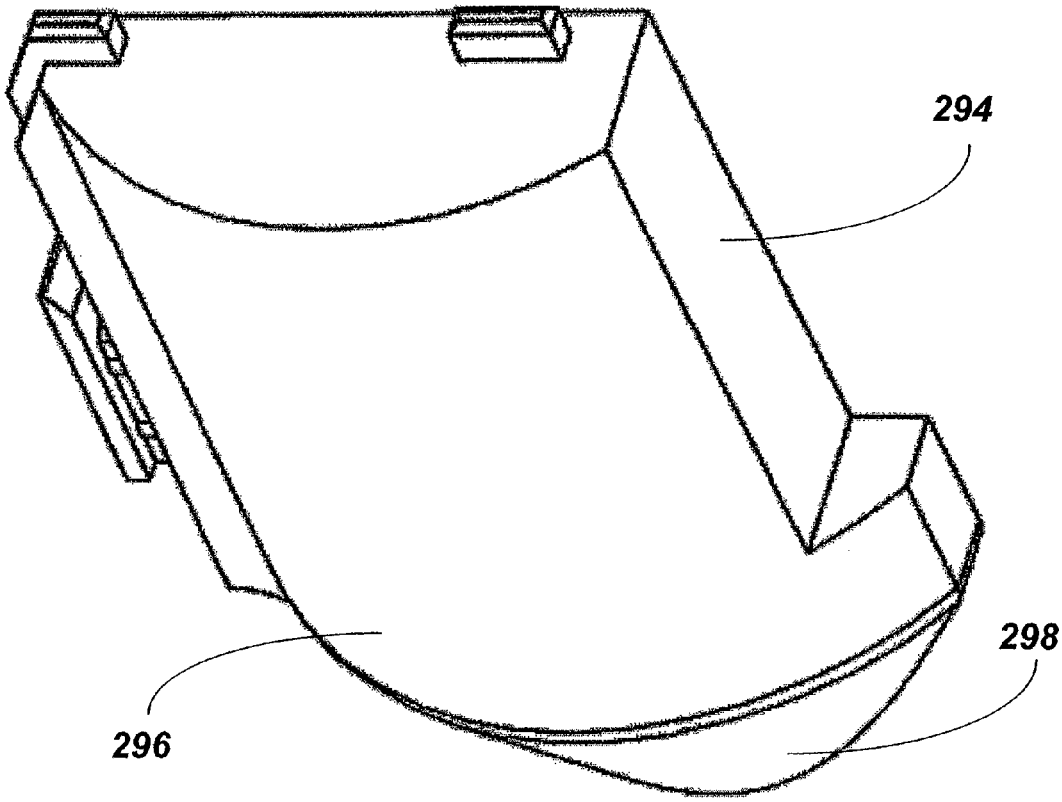
FIG. 2*k* is a sketch of an alignment module according to an embodiment of the invention.
Figure 2I:
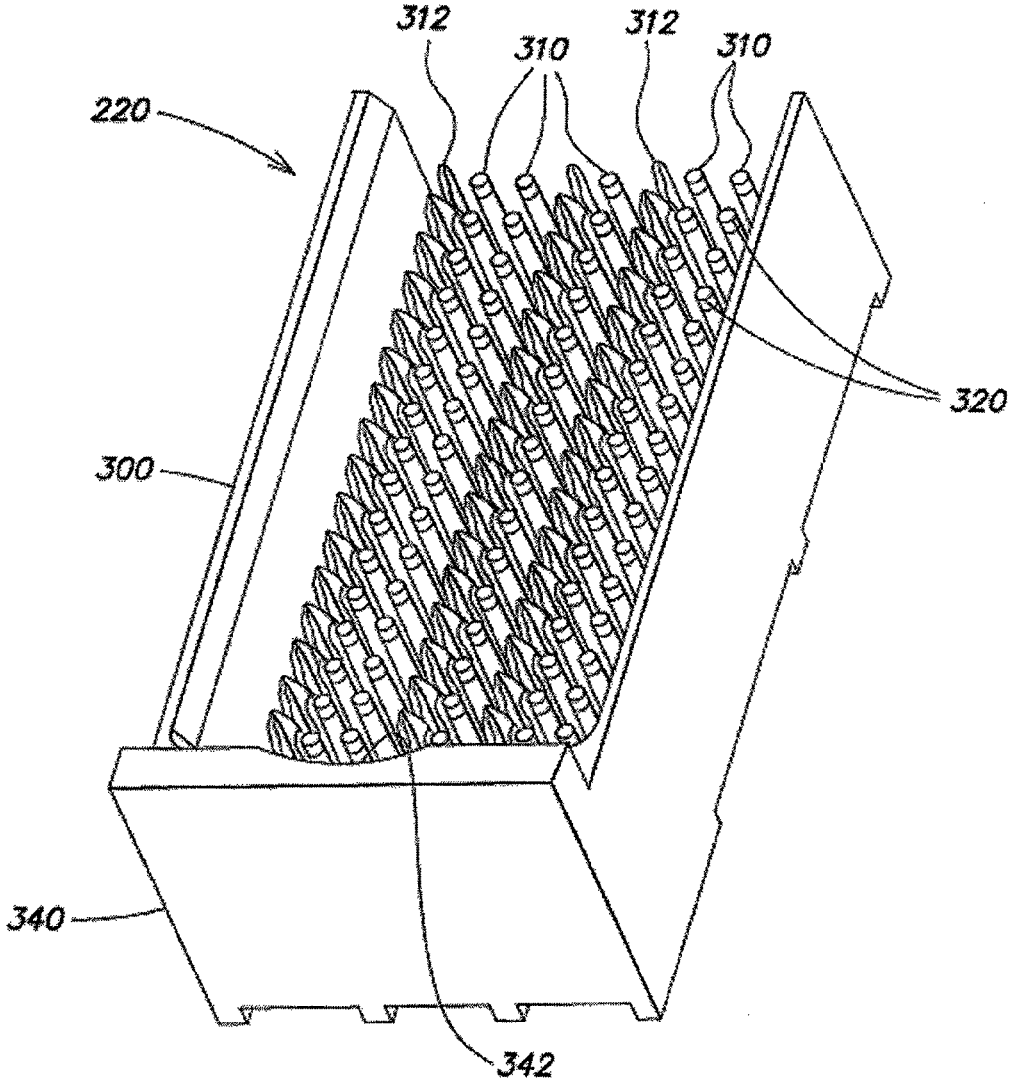

Another guidance feature may be added to the wafer assembly 210 for facilitating connection to the backplane connector 220. For example, a guide piece 294 may be coupled to the organizer 240 at the end of the array of wafers (FIGS. 2*a* and 2*k*). The guide piece 294 may include a main body 296 having a generally convex outer surface and end portion 298 that is tapered for reception in a corresponding portion of the backplane connector 220.

As best seen in FIGS. 2*a*-2*d* and 2*l*, the backplane connector 220 may include a U-shaped housing 300 with a main body 302, two longitudinal sidewalls 304, and two open ends 306. Slots 305 are provided on the inner surfaces of the sidewalls 304 for receiving the wafers 230. Slots 305 may be configured to receive the guide portions 290 of each wafer. A plurality of openings 308 (FIG. 2*d*) that receive contacts 310 and 312 designated for both signal and ground are located in the main body 302. The contacts 310 and 312 are arranged in rows between open ends 306 and may alternate between signal and ground. For example, five rows of signal contacts 310 may alternate with three rows of ground contacts 312 (FIG. 2*j*). The signal contacts 310 correspond to the signal tracks 266 of the wafers 230 and the ground contacts 312 correspond to the ground contact areas 282 of the wafers 230.

Each of the signal contacts 310 may include a first end 320, such as a receptacle that mates with the ends of the signal tracks 266 of each wafer 230 at the second mating interface 252. An insulator 324 may be provided around the first ends 320. The second ends 322 extending through the main body 302 may terminate in a press-fit pin for connection to the backplane. Because the first ends 320 of the signal contacts 310 are compliant, movement is allowed when the wafers 230 are mated with the backplane connector 260, thereby providing tolerance.

Each of the ground contacts 312 may include a first end 330 (FIG. 2*h*) with first and second spring arms for engaging the ground contact areas 282 of each wafer 230. The second opposite ends 334 extend through the main body 302 and terminate in press-fit section 336 for engagement with the backplane.

One of the open ends 306 of the housing may be closed off by a guide receiving wall 340 (FIG. 2*l*). The guide receiving wall 340 may include, for example, a concave recessed portion 342 on its inner surface for receiving the guide piece 292 of the wafer assembly.

Figure 3:
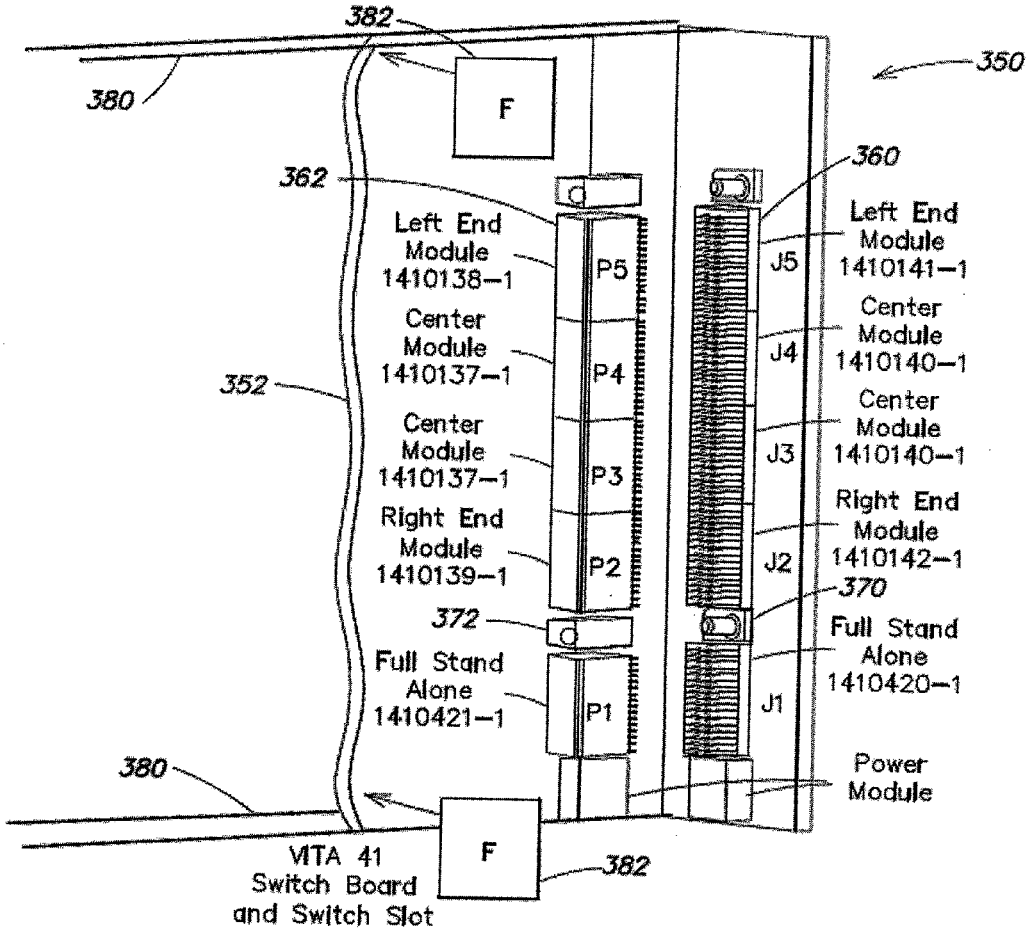
FIG. 3 is a sketch of an electronic assembly that may employ connectors according to an embodiment of the invention.

FIG. 3 illustrates an electronic assembly in which connectors according to embodiments of the invention may be used. FIG. 3 illustrates portions of an electronic assembly that includes a backplane 350. One or more daughtercards 352 may be mounted in the electronic assembly of FIG. 3. Backplane 350 may include one or more backplane connectors 360, which may be constructed according to an embodiment of the invention. Likewise, daughtercard 352 may include daughtercard connectors 362 according to an embodiment of the invention.

Daughtercard 352 may slide along rails 380 that provide a coarse alignment between daughtercard connector 362 and backplane connector 360. More precise alignment may be provided by alignment modules 370 on backplane 350 and corresponding alignment modules 372 on daughtercard 352. In this embodiment, alignment module 370 is in the shape of a post and alignment module 372 is in the shape of a receptacle that has a wide gathering area to ensure that alignment module 372 will engage the post of alignment module 370.

To provide a ruggidized assembly, rail locks 382 are sometimes used to secure daughtercard 352 within the electronic assembly. Rail locks 382 are illustrated schematically in FIG. 3. Rail locks operate by pressing daughtercard 352 against rails 380 and may be constructed with a camming surface or any other suitable mechanism to assert a force on daughtercard 352 to hold it securely in place. Rail locks 382 may be desirable for use in a ruggidized assembly because once engaged, they may limit vibration of daughter card 352. Vibration of daughter card 352 may cause excessive wear or fretting corrosion at the mating interface between daughter card connector 362 and backplane connector 360 or other performance problems. When rail locks 382 operate, daughtercard 352 may move relative to backplane 350. For this reason, it may be desirable to incorporate "float" into the connection system formed by backplane connector 360 and daughtercard connector 362. As described below, connectors according to some embodiments of the invention may be constructed with features that facilitate float so that rail locks may be used in an electronic assembly to provide a more ruggidized assembly.

FIG. 3 also illustrates how use of a connector using a guide piece such as a guide piece 294 may facilitate construction of electronic assemblies using fluid for cooling. FIG. 2*a* illustrates a backplane connector 220 designed to receive a daughtercard connector with a guide piece 294. Guide piece 294 may be used in place of alignment modules 370 and 372 (FIG. 3) to create additional space on backplane 350 for other components. Accordingly, FIG. 2*a* illustrates a fluid quick connect 286 mounted adjacent to backplane connector 220. Quick connect 286 is mounted in the same position occupied by alignment module 370. Quick connector 286 may be used to distribute cooling fluid to a daughtercard, such as daughtercard 352, when inserted into an electronic assembly.

Figure 4A:
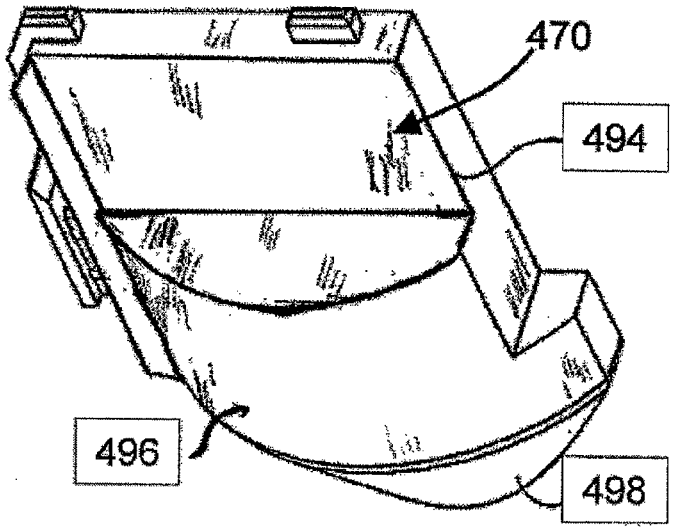
FIGS. 4*a* and 4*b* are sketches of a connector assembly with an alignment module according to an alternative embodiment of the invention.
Figure 4B:
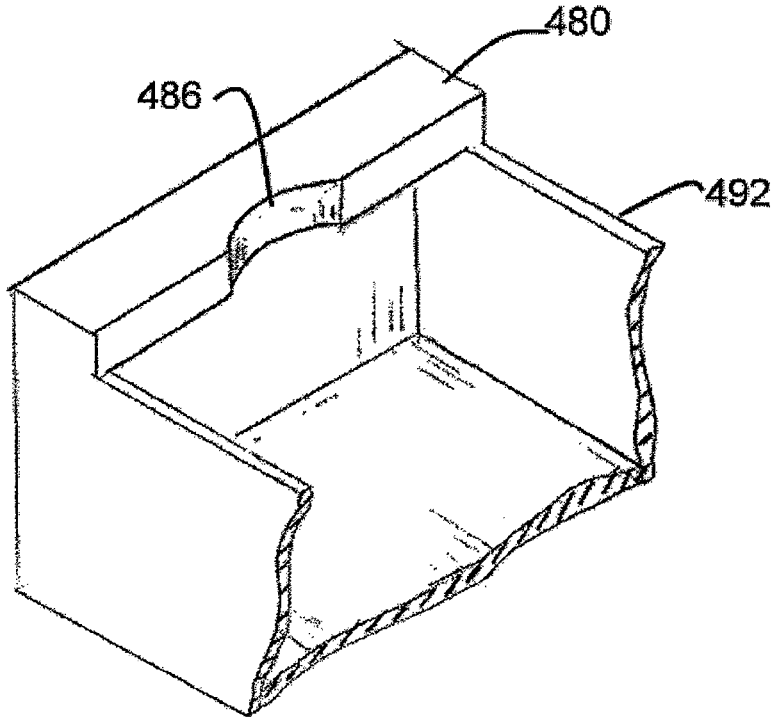

Turning to FIGS. 4*a* and 4*b*, an alternative embodiment of guide piece 294 is shown. In the embodiment illustrated, guide piece 494 is configured to allow float so the rail locks may be used. Guide piece 494 may be attached to a wafer organizer similarly to guide piece 294. As with guide piece 294, guide piece 494 includes a tapered portion 498 and a main body 496. Tapered portion 498 is adapted to engage a recess 496 (FIG. 4*b*) in a backplane housing 492. Tapered portion 498 performs a gathering function, ensuring that main body 496 aligns with recess 486 as guidepiece 494 is inserted into housing 492.

However, guidepiece 494 differs from guidepiece 294 in that guidepiece 494 includes a relieved portion 470. As a daughtercard connector including a guidepiece 494 mates with a backplane connector with a housing in the form of housing 492, the connectors are aligned by the action of tapered portion 498 and main body 496 engaging with recess 496. The alignment provided by the interaction of these components insures that the connectors are appropriately aligned to avoid stubbing as the daughtercard connector and backplane connector begin to mate. However, once the mating operation has proceeded to the point that the daughtercard connector is pressed into housing 492 sufficiently far that mating contacts from the daughter card connector have engaged corresponding contacts from the backplane connector, main body 496 will pass ledge 480. In this position, relieved portion 470 will align with ledge 480 and main body 496 no longer engages recess 486 to hold the daughtercard connector relative to housing 492. In this way, the daughtercard connector may float relative to backplane connector housing 492. Thus, guide piece 494 provides alignment during the beginning of the mating sequence when stubbing could occur. At the end of the mating sequence, guide piece 494 allows float so that a cam lock may be used to hold a daughtercard firmly in an electronic assembly.

In the embodiment illustrated, main body 496 has a curved surface similar to the curved surface 296 of guidepiece 294. This shape conforms to the shape of recess 486. It is not necessary that mainbody 496 have a curved surface. Main body 496 may have any suitable shape, with recess 486 having a shape complimentary to the shape of main body 496. For example, main body 496 may be rectangular, triangular or may contain multiple projections. In some embodiments, an electronic assembly using guidepieces as illustrated in FIGS. 4*a* and 4*b* may have guide pieces on different daughtercards having main bodies with different shapes. By providing daughter cards with connectors using alignment pieces of different shapes, each daughtercard will be able to engage only those backplane connectors having corresponding recesses with shapes complimentary to the shape of the main body used for that daughtercard connector. In this way, daughtercards may be precluded from being inserted into backplane connectors not designed to receive those daughtercards.

Figure 5:
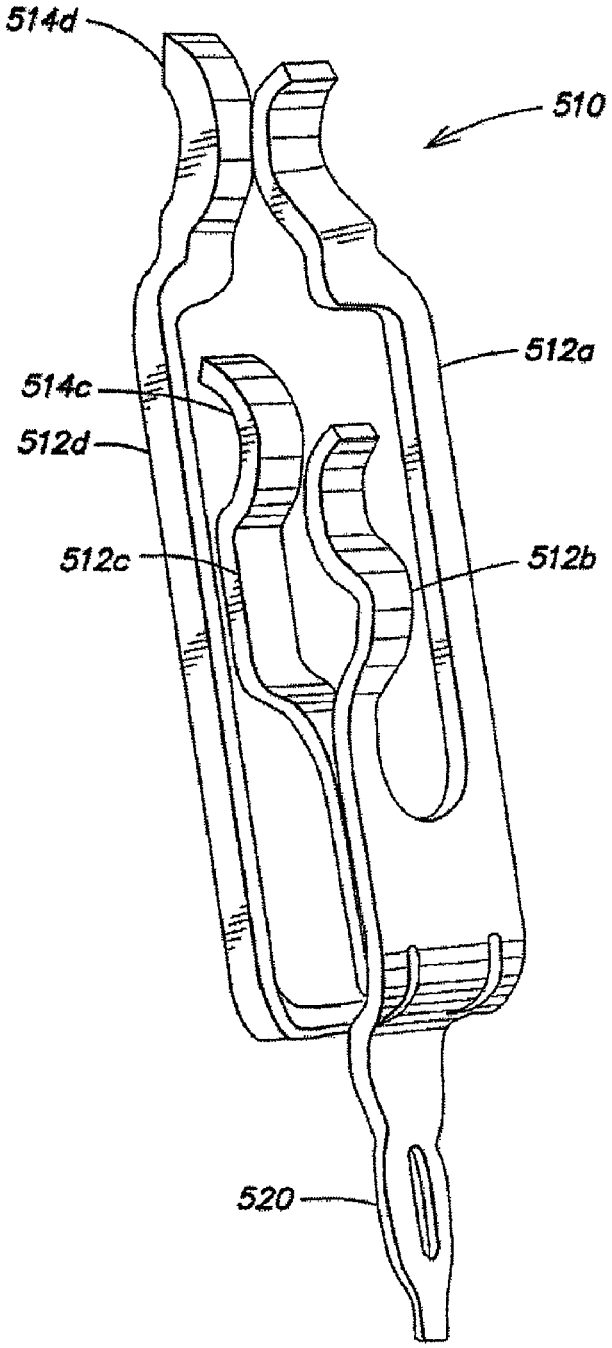
FIG. 5 is a sketch of a conductive element according to an embodiment of the invention.

FIG. 5 illustrates conductive element 510 that may be used in a backplane connector according to an embodiment of the invention. In the embodiment illustrated, conductive element 510 is designed for use in a ruggedized system—both because it facilitates connector float so that rail locks may be used and because it provides reliable contact. Conductive element 510 includes four beams, 512*a*, 512*b*, 512*c* and 512*d*. Each of the beams has a contact surface, of which contact surfaces 514*c* and 514*d* are visible in FIG. 5. Conductive element 510 is designed to receive a mating contact portion so that beams 512*a* and 512*b* press on one side of the mating contact portion and beams 512*c* and 512*d* press on an opposing side of the mating contact portion.

In this way, conductive element 510 provides four points of contact. Providing multiple points of contact increases the reliability of any electrical connection formed between conductive element 510 and a mating contact portion. Further, in the embodiment of FIG. 5, beams 512*a*, 512*b*, 512*c* and 512*d* are curved to bring the contact surfaces near the center of conductive element 510. By positioning the contact surfaces near the center, greater float is enabled. The additional float achieved with the contact configuration of FIG. 5 is illustrated below in connection with FIG. 6*d*.

Conductive element 510 may be formed in any suitable way. In the embodiment illustrated, conductive element 510 is stamped from a sheet of flexible metal. Conductive element 510 may be formed from a copper alloy, such as beryllium copper or phosphor bronze, or may be formed from any other suitably flexible and conductive material. Conductive element 510 may be formed in any suitable way. In the embodiment illustrated, the beams are stamped from a sheet of metal and then formed as illustrated. A contact tail 520 may be stamped from the same sheet of metal and integrally formed as a part of conductive element 510.

Figure 6A:
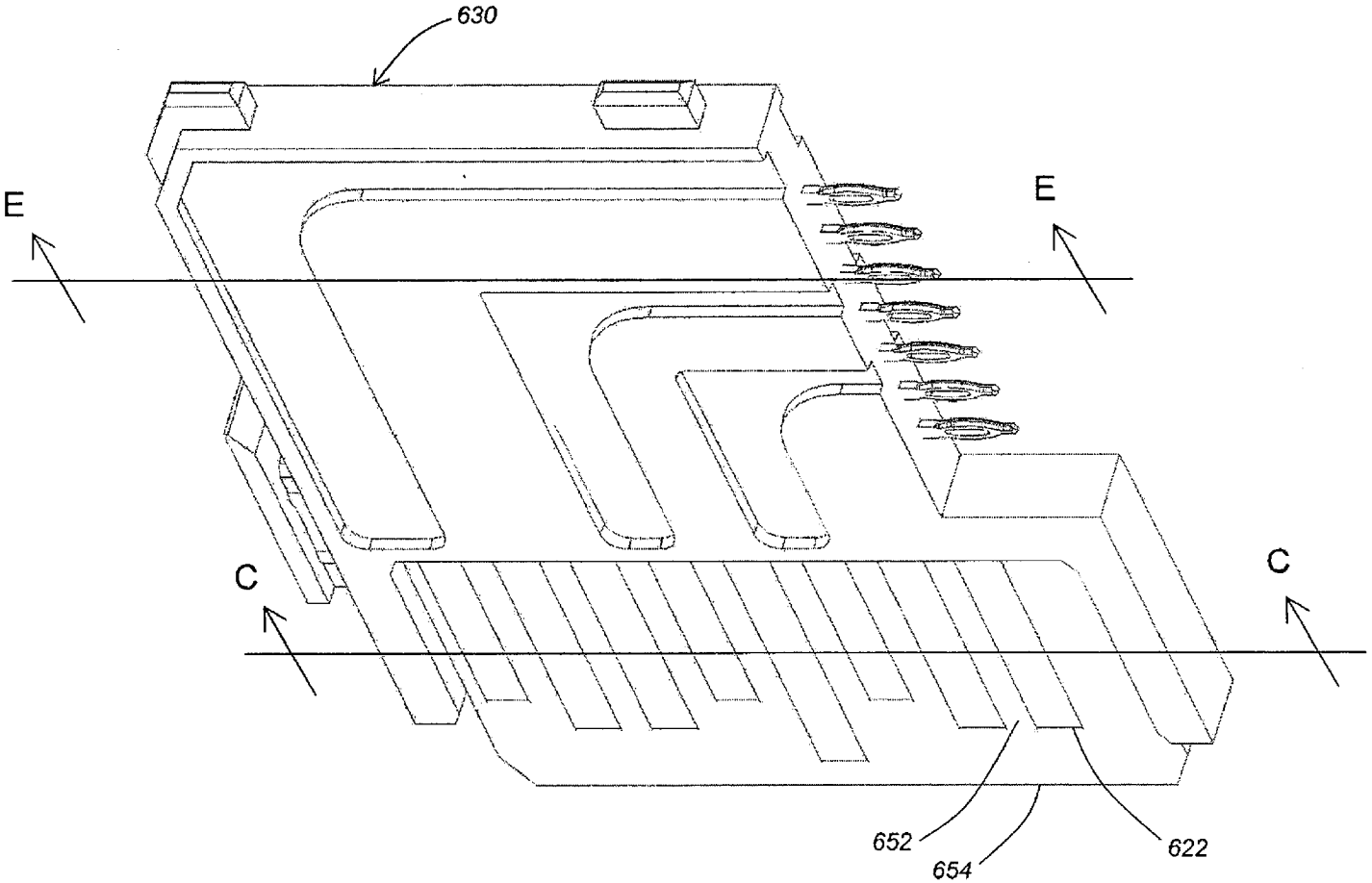
FIG. 6*a* illustrates a wafer according to an embodiment of the invention.
Figure 6B:
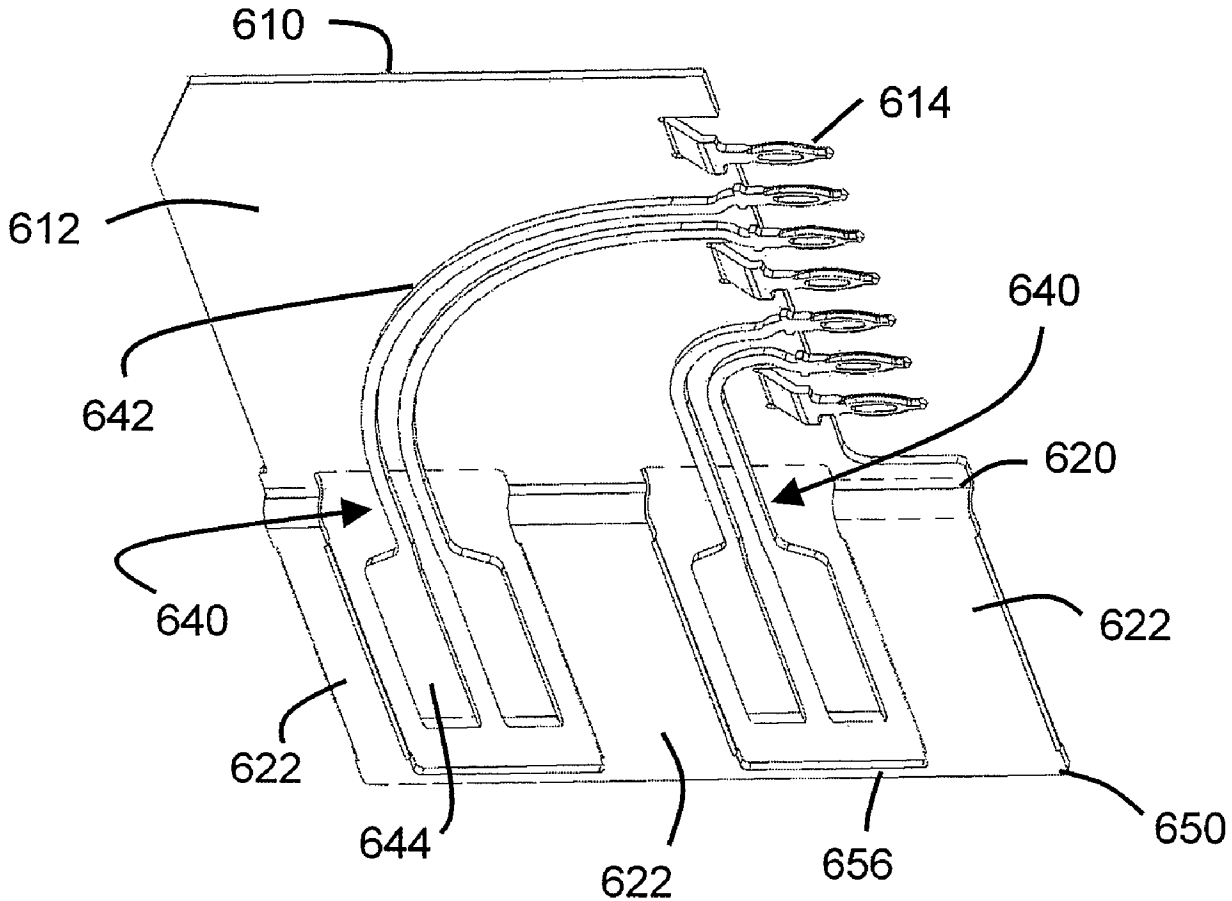
FIG. 6*b* illustrates conductive elements within the wafer of FIG. 6*a;*

Turning to FIGS. 6*a* and 6*b*, additional details of a wafer 630 according to an embodiment of the invention are shown. FIG. 6*a* shows wafer 630 including an insulative housing. FIG. 6*b* shows the conductive elements of wafer 630 without the housing. As shown in FIG. 6*b*, shield 610 includes a planar portion 612. Contact tails, of which contact tail 614 is numbered, extend from planar portion 612.

Intermediate portion 642 of signal conductors 640 overlay planar portion 612. Intermediate portion 642 may be spaced from planar portion 612 by an amount that provides a desired impedance to signal conductors 640. In the embodiment illustrated, signal conductors 640 are arranged in differential pairs. In a differential configuration, the signal conductors may have an impedance of 100 Ohms or any other suitable value.

Each of the signal conductors terminates in a mating contact portion, here shown as pads 644. In the embodiment of FIG. 6*b*, the pads 644 are positioned in a plane, forming a column of signal contacts for wafer 630.

In the embodiment illustrated, the column of signal contacts also includes ground contacts. Those ground contacts are formed by pads 622 of shield 610. To align pads 622 in the same plane as pad 644, shield 610 includes a transition region 620 in which shield 610 is bent out of the plane containing planar portion 612 and into the plane containing pads 644. To avoid contact between shield 610 and signal conductors 640, shield 610 may include openings where shield 610 and signal conductors 640 are in the same plane.

As shown in FIG. 6*b*, pads 622 are separated from pads 644. This configuration avoids shorting signal conductors 640 to ground. When an insulative housing is molded around shield 610 and signal conductors 640, the space between pads 622 and 644 may be filled with insulative material of the housing. This insulative material forms regions 652 (FIG. 6*a*) and ensures that pads 644 do not touch pads 622. However, any suitable structure for isolating signal conductors 640 from shield 610 may be used.

As described above, it may be desirable for shield 610 to extend to the mating face of wafer 630 to avoid electrostatic discharge through signal conductors. Accordingly, the embodiment of FIG. 6*b* illustrates edge 650 of shield 610 extending beyond pads 622 and 644 to provide a shield extension 656.

In some embodiments, it may be undesirable to have edge 650 exposed on the surface of wafer 630 where mating contacts from a backplane connector engage pads 644. If shield extension 656 were exposed, a mating contact portion in a backplane connector sliding across the surface of wafer 630 to engage a signal pad 644 could be shorted to shield extension 656. Accordingly, edge 650 may be thinner than pads 644 and may be over-molded with insulative portion 654 (FIG. 6*a*). Insulative portion 654 prevents a mating contact sliding into engagement with pads 644 from contacting shield extension 656.

Shield 610 and signal conductors 640 may be formed in any suitable way. For example, they may be stamped from sheets of metal and formed into the desired shapes. In the embodiment illustrated, shield 610 and signal conductors 640 may be separately stamped and overlaid after stamping. Though in other embodiments, both shields and signal conductors may be stamped from the same sheet of metal. Shield extension 656 may be formed in any suitable way. For example, shield extension 656 may be formed to be thinner than pads 644 by coining edge 650 of shield 610.

Figure 6C:
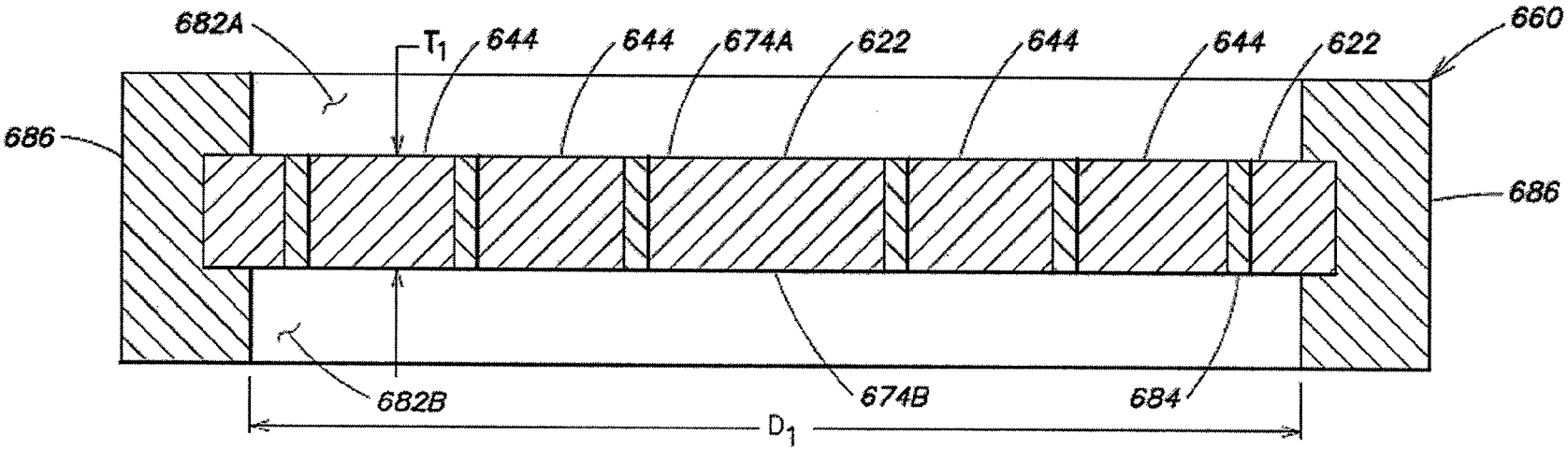
FIG. 6*c* is a cross-section of the wafer of FIG. 6*a* through the line c-c.

FIG. 6*c* shows a wafer 630 in cross-section taken along line C-C through the mating segment of wafer 630. As shown, signal conductors and reference conductors are held within housing 660. Cut-out portions 682*a* and 682*b* on both sides of housing 660 expose terminal portions of the signal conductors and ground conductors, forming pads 644 on the signal conductors and pads 622 on the ground conductors.

In the embodiment illustrated, cut-out portions 682*a* and 862*b* expose the signal conductors and ground conductors on two surfaces, surfaces 674*a* and 674*b*. This configuration allows electrical connection to be made to each of the pads from both surface 674*a* and 674*b*. Making contact on two surfaces of a pad may be desirable because redundancy improves the reliability of the electrical connection formed to such a pad.

In some embodiments, the signal conductors and ground conductors are formed from a material having a thickness sufficient to provide a robust pad. For example, the material may have a thickness $T_1$ in excess of 8 mils. In some embodiments, the thickness may be between about 10 and 12 mils.

Figure 6D:
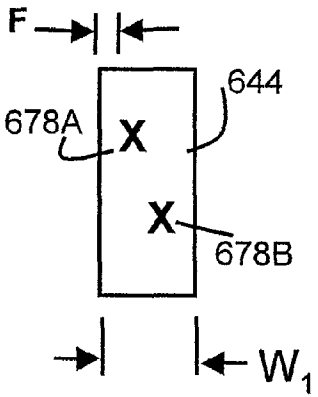
FIG. 6*d* is a sketch illustrating points of contact on one side of a conductive element of the wafer of FIG. 6*a;*

In some embodiments, a backplane connector may be formed to create multiple points of contact to each of the signal conducting pads and/or each of the reference conductor pads. For example, FIG. 6*d* illustrates one surface of a pad 644. Two points of contact, contact point 678*a* and 678*b* are illustrated. Two such points of contact may be formed using a conductive element in the form of conductive element 510 (FIG. 5). Two such points of contact may, for example, be formed by beams 512*a* and 512*b* pressing against one surface of pad 644. If a contact in the form of conductive element 510 is used, two similar points of contact will be provided on an opposing surface of pad 644. Collectively, four points of contact may thus be formed to pad 644. Providing four points of contact in this fashion may increase the robustness and reliability of a connector formed using wafers such as 630. However, any suitable number of points of contact may be used.

Figure 7:
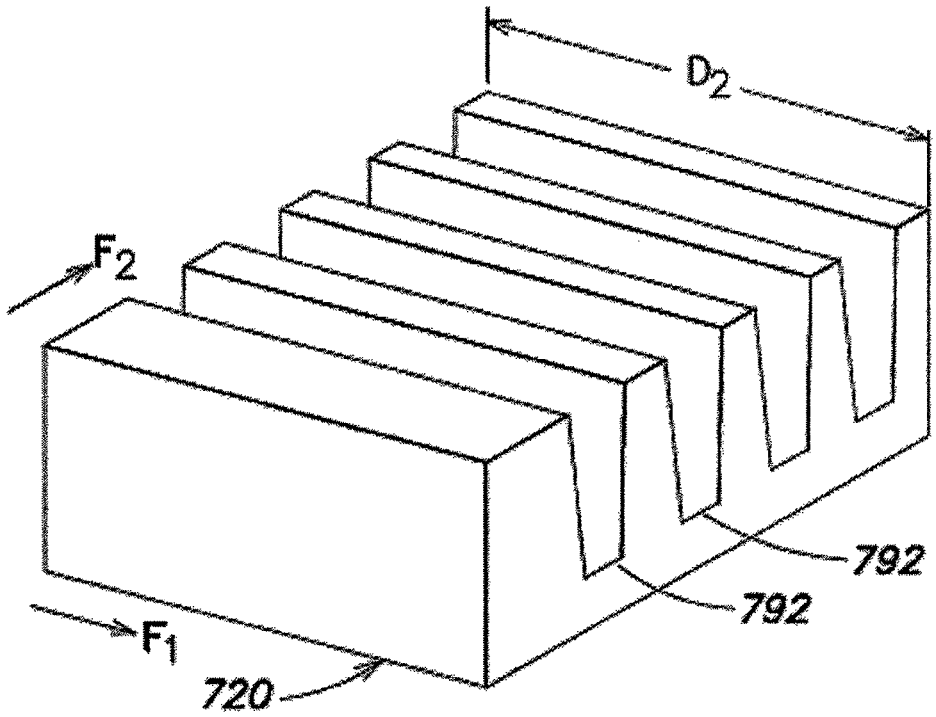
FIG. 7 is a sketch of a backplane housing according to an embodiment of the invention.

FIGS. 6*c* and 6*d* also illustrate how a wafer in the form of wafer 630 may accommodate float to accommodate rail locks or for other reasons. Wafer 630 includes a contact portion 684 that is designed for insertion into a slot, such as slot 792, in a backplane connector housing 720 (FIG. 7). Contact portion 684 is bounded by sidewalls 686 that are positioned outside of housing 720 when wafer 630 is mated with a backplane connector. In the embodiment illustrated, sidewalls 686 limit the range of float of wafer 630 relative to housing 720.

In the embodiment illustrated, wafer 630 is formed with cut-out portions 682*a* and 682*b* that provide a spacing $D_1$ between sidewalls 686. The dimension $D_1$ may be larger than the width of housing 720 represented by $D_2$ (FIG. 7). By making dimension $D_1$ larger than $D_2$, wafer 630 may float in direction $F_1$ (FIG. 7). Float in direction $F_2$ may also be provided by compliance of beams forming the contact elements in a backplane connector. For example, if a conductive element in the form of conductive element 510 is used, beams 512*a*, 512*b*, 512*c* and 512*d* may provide float in direction $F_2$.

If wafer 630 is allowed to float in direction $F_1$, it may be desirable that the allowed range of float not preclude alignment of the mating contact portions of conductive elements in a backplane connector and pads 644 in wafer 630. As described above in FIG. 5, the contact surfaces on the beams used to form conductive element 510 are curved to position the contact surfaces closer to the center line of conductive elements 510. As a result, when a contact element 510 is aligned with pad 644, points of contact 678*a* and 678*b* between the mating surfaces of element 510 and pad 644 may be positioned near the center of pad 644.

In the embodiment shown, the configuration of the contact element 510 ensures that points of contact 678*a* and 678*b* are spaced apart by a distance that is less that the width $W_1$ of pad 644. As a result, wafer 630 may float relative to contact element 510 by an amount F and points of contact 678*a* and 678*b* will still be on pad 644. In some embodiments, the difference between dimensions $D_1$ and $D_2$ will be less than the distance F, though any suitable dimensions may be used.

Figure 6E:
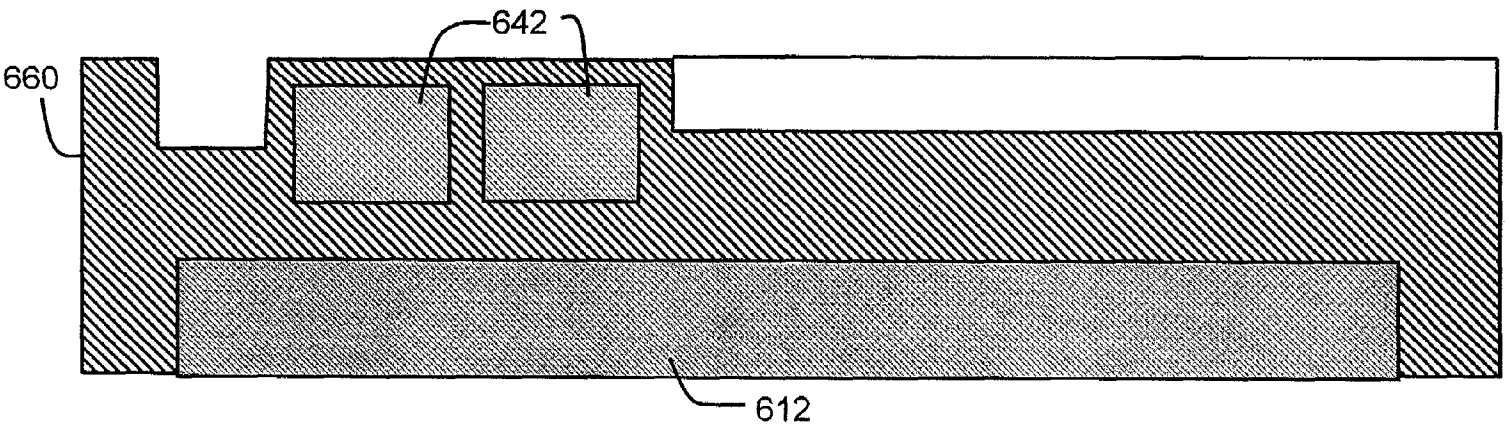
FIG. 6*e* is a cross-section through the wafer of FIG. 6*a* taken along the line e-e.

Turning to FIG. 6*e*, a strip line construction that may be achieved using a wafer as illustrated in FIG. 6*a* is shown. FIG. 6*e* shows a cross-section taken through the intermediate portions of signal conductors in wafer 630. In the example shown, the cross-section passes through intermediate portions 642 of signal conductor s640. As can be seen, the intermediate portions 642 are spaced from a ground plane formed by planar portion 612 of shield 610. The desired spacing between intermediate portions 642 and planar portion 612 may be set by insulative housing 660 that may be molded around signal conductors 640 and shield 610.

In the embodiment illustrated, the intermediate portions 642 of signal conductors 640 are embedded with insulative housing 660. Shield plate 610 is partially embedded within housing 660. However, in some embodiments, planar portion 612 may be fully embedded within housing 660.

Figure 6F:
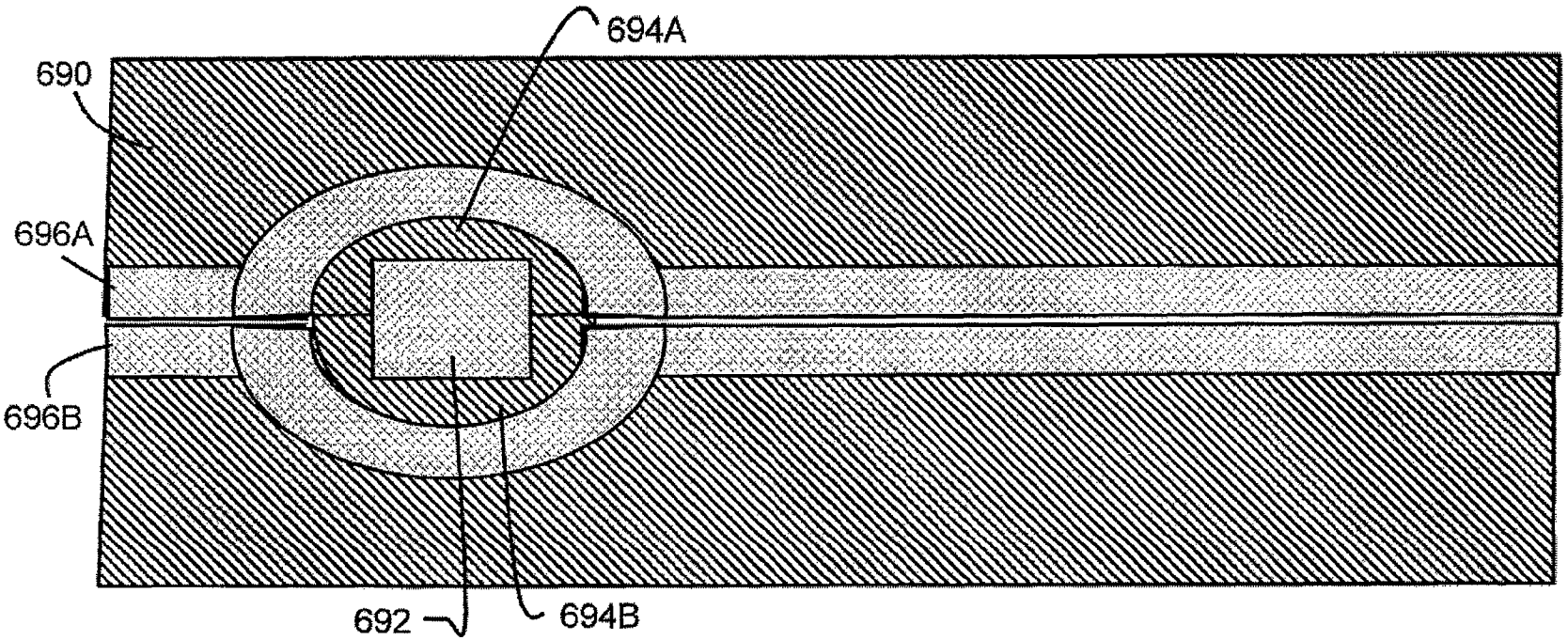
FIG. 6*f* is a cross-section of a wafer according to an alternative embodiment of the invention.

FIG. 6*f* illustrates a cross-section of an alternative construction of a wafer according to some embodiments of the invention. FIG. 6*f* illustrates a cross-section through an intermediate portion of a signal conductor 692. In the embodiment illustrated, two shields 696*a* and 686*b* are used. Each shield has a channel 694*a* and 694*b*, respectively. The channels 694*a* and 694*b* are used to receive a signal conductor 692. The structure may be held together by an insulative housing 690 or in any other suitable way.

Housing 690 may include an insulative portion filling channels 694*a* and 694*b* not occupied by signal conductors 692. When ground plates 696*a* and 696*b* are connected to ground, they, in conjunction with signal conductor 692, form a co-axial signal path, which may have desirable signal conducting properties.

FIG. 6*f* illustrates a cross-section through a portion of a wafer. One wafer may contain multiple signal conductors in the form of signal conductor 692 or in any other suitable form. Each such signal conductor 692 may be disposed in recesses in shields such as 696*a* and 696*b*.

Figure 8:
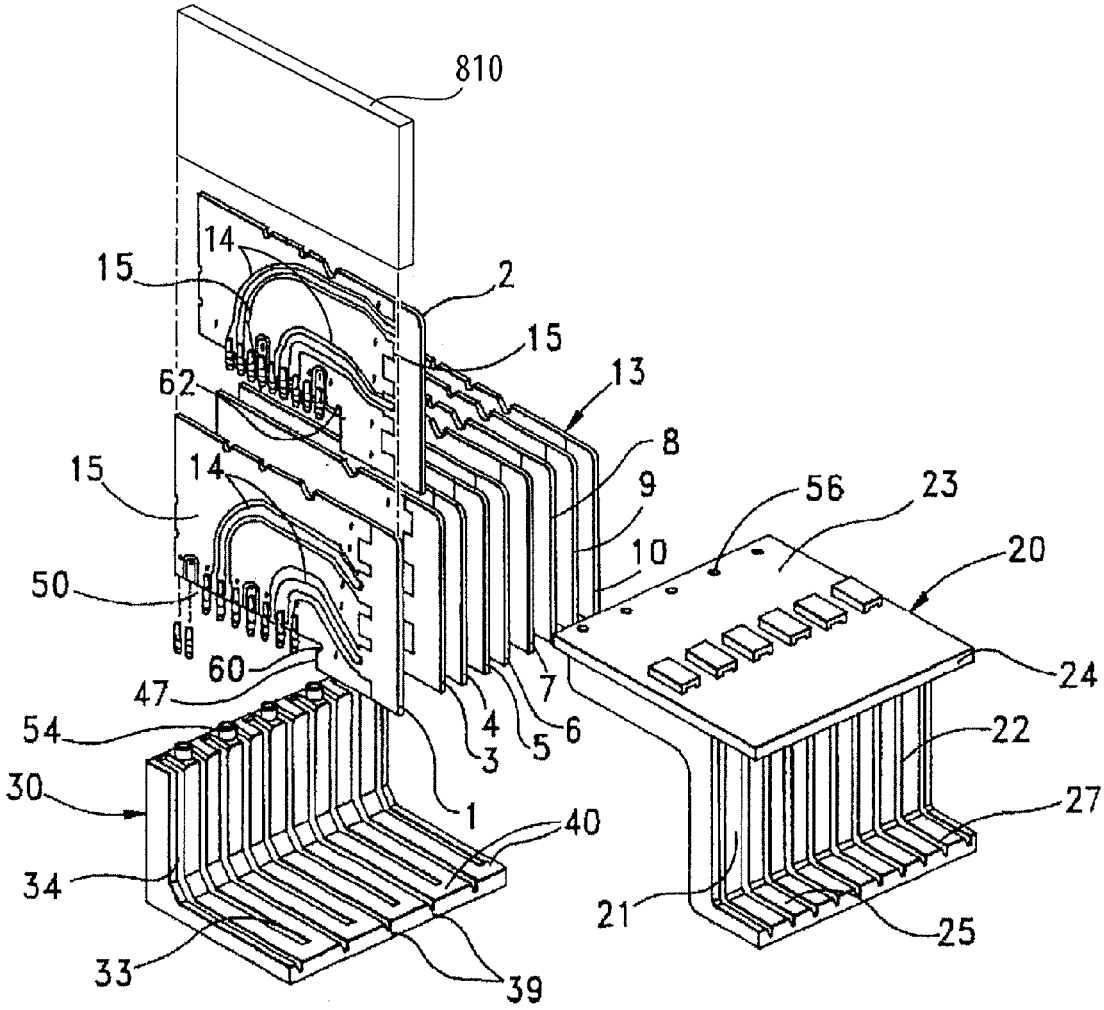
FIG. 8 is a sketch of an alternative embodiment of a connector assembly with shock absorbing members positioned between subassemblies.

Turning to FIG. 8, an alternative embodiment of an electrical connector is illustrated. In the connector of FIG. 8, a plurality of wafers such as wafers 1 . . . 10 are formed using printed circuit board manufacturing techniques. Conductive traces acting as signal conductors and reference conductors may be patterned on substrates, such as sheets of FR4. The conductive elements may be patterned using photolithography or other suitable manufacturing technique.

The wafers 1 . . . 10 may be held in parallel within one or more organizers, such as organizers 20 and 30. However, any suitable assembly technique may be used.

In some embodiments, wafers 1 . . . 10 may be formed using a relatively small number of layers. For example, wafers 1 . . . 10 may be formed using two-layer printed circuit boards. Such a construction may not be adequately rugged for some applications.

To provide a more robust connector, shock absorbing members, of which shock absorbing member 810 is illustrated, may be positioned between adjacent wafers 1 . . . 10. Shock absorbing members may be manufactured from any suitable shock-absorbing material. In the illustrated embodiment, shock absorbing member 810 is formed from an insulative material. Examples of materials that may be used for form shock absorbing members include rubber and silicone.

Each shock absorbing member may be held in position in any suitable way. The shock absorbing members may be held in place by attachment features on the wafer organizers, by an adhesive applied to the surface of each wafer, by friction caused by force on the shock absorbing member asserted by wafers pressing against the shock absorbing member or in any other suitable way.

Figure 9:
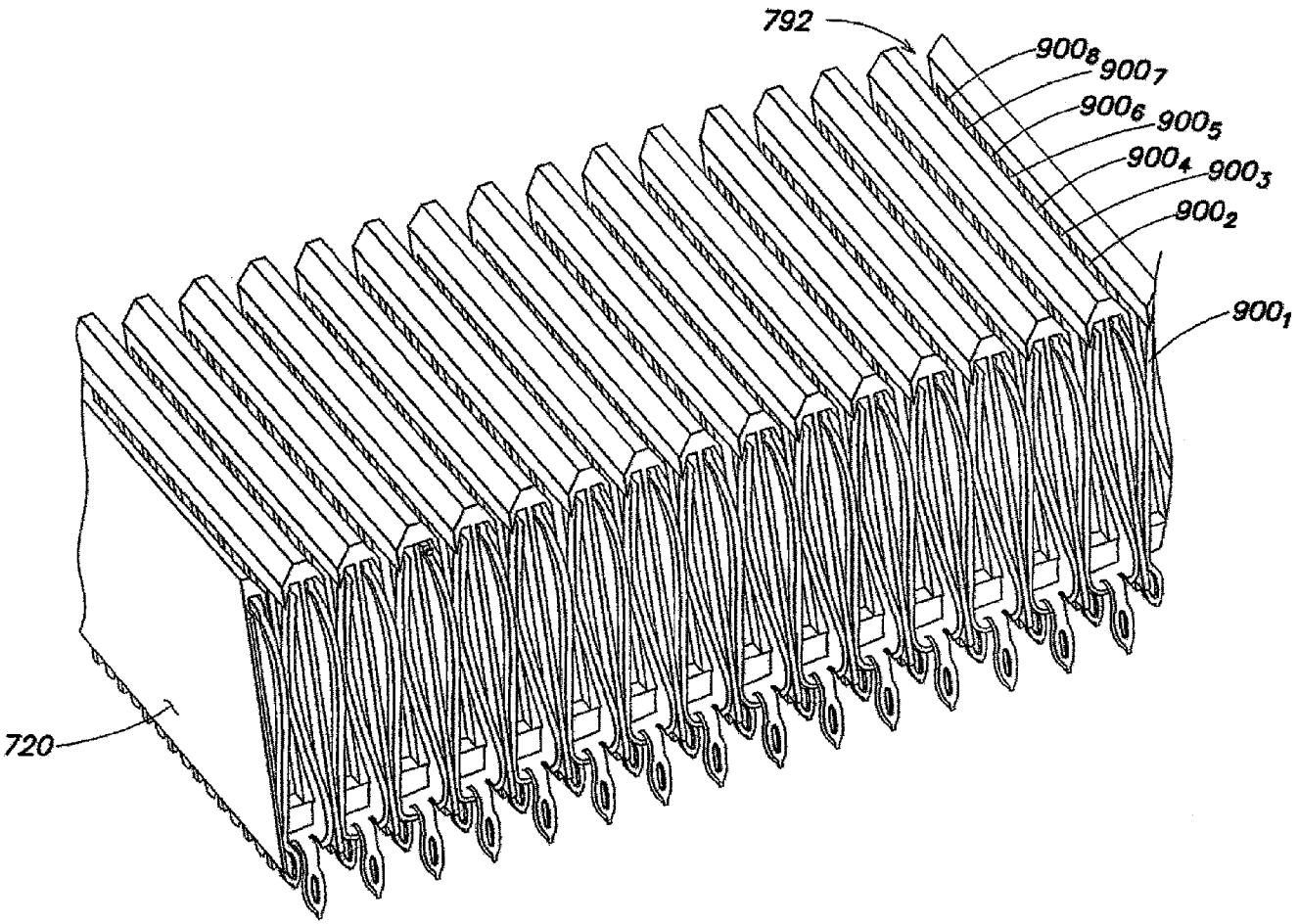
FIG. 9 is a sketch of a backplane connector, partially cut away, according to an embodiment of the invention.

FIG. 9 shows a backplane connector 720 according to some embodiments of the invention. Backplane connector 720 may incorporate contacts such as contact 510 (FIG. 5). Though, in the embodiment illustrated a contact that facilitates more control over insertion force is used. Backplane connector 720 has slots, such as slot 792. Each slot is lined with multiple contacts, of which contacts $\mathbf{900}_1$ . . . $\mathbf{900}_8$ are numbered. As shown, eight contacts $\mathbf{900}_1$ . . . $\mathbf{900}_8$ per slot are used, though a connector may be constructed with any number of contacts.

In the embodiment illustrated, both signal and ground contacts have the same shape. Though, it is not a requirement that all contacts in a slot have the same shape or that all slots in a connector contain the same number or type of contacts.

Figure 10B:
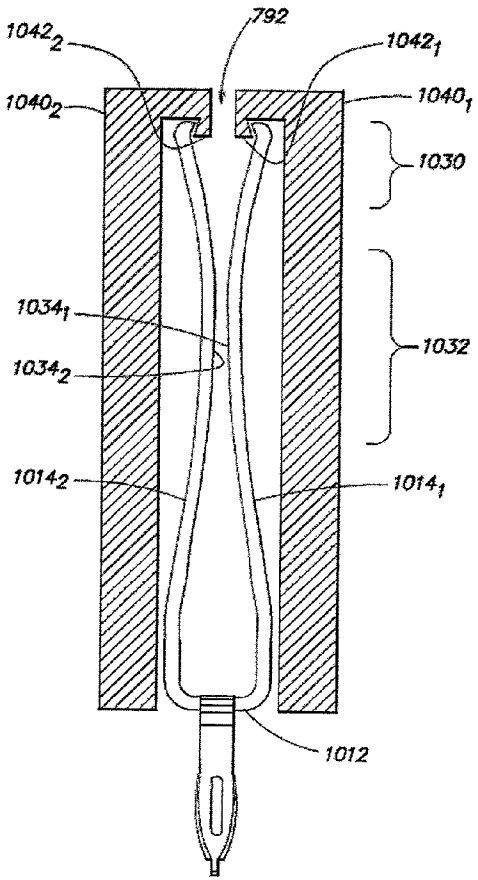
FIG. 10B is a cross sectional view of a portion of the backplane connector of FIG. 9.
Figure 10A:
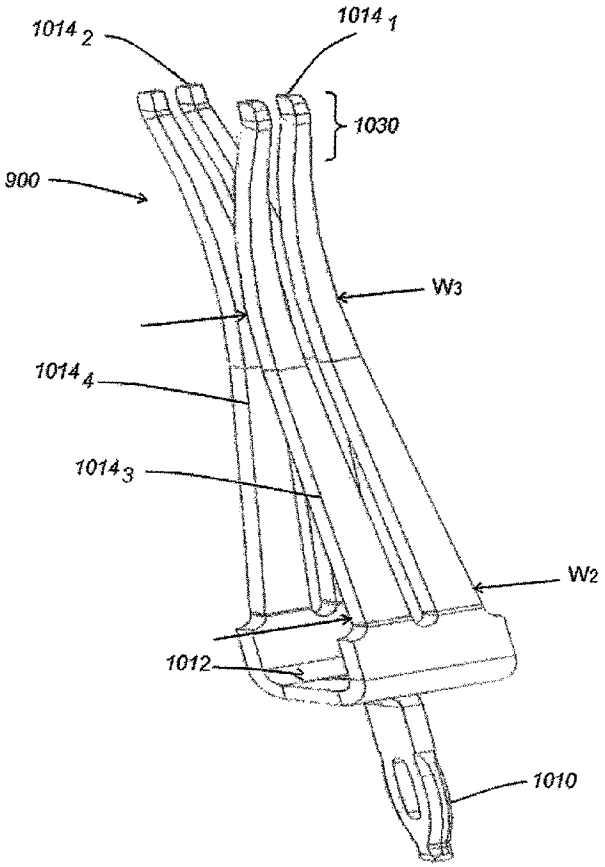
FIG. 10A is a sketch of a contact of the backplane connector of FIG. 9.

A representative contact 900 is shown in FIG. 10A. Contact 900, like contact 510 (FIG. 5), provides multiple points of contact. In the illustrated embodiment, contact 900 provides four points of contact. Though, each contact could provide more or fewer points of contact. Contact 900 also arranges the points of contact to be spaced less than the width of a pad to which contact 900 mates. Such spacing may be used to facilitate float of the connector. Also as with contact 510, contact 900 may be stamped and then formed from a sheet of flexible, conductive material, such as a copper alloy or other suitable metal.

As shown in FIG. 10A, contact 900 is formed with a base 1012. Contact tail 1010 extends from one surface of base 1012. In the embodiment illustrated, contact tail 1010 extends perpendicular to base 1012, though the specific manner in which contact tail 1010 is incorporated into contact 900 is not critical to the invention. Contact tail 1010 may have any suitable shape, though in the embodiment illustrated, contact tail 1010 is a press-fit, eye-of-the-needle contact tail.

Multiple members may also extend from base 1012 to form the mating portions of contact 900. In the embodiment illustrated, four members $\mathbf{1014}_1$ . . . $\mathbf{1014}_4$ are shown. In some embodiments, each contact will have an even number of opposing members. An even number of opposing members allows contact 900 to engage two sides of a mating contact portion from a mating connector. However, the number and type of contact members is not critical to the invention.

In the embodiment of FIG. 10A, the members $\mathbf{1014}_1$ . . . $\mathbf{1014}_4$ collectively provide four points of contact. FIG. 10B shows a side view of contact 900 in which mating surfaces $\mathbf{1034}_1$ and $\mathbf{1034}_2$ on members $\mathbf{1014}_1$ and $\mathbf{1014}_2$ are visible. Similar mating surfaces may be provided on contacts $\mathbf{1014}_2$ and $\mathbf{1014}_3$, though not visible in FIG. 10B.

As shown in FIG. 10A, members $\mathbf{1014}_1$ and $\mathbf{1014}_2$, where attached to base 1012, span a width of $W_2$. In a mating contact region, the width spanned by members $\mathbf{1014}_1$ and $\mathbf{1014}_2$ decreases to $W_3$. In the illustrated embodiment, $W_3$ is less than the width $W_1$ of a pad, such as pad 644 (FIG. 6D), to which contact 900 may make a connection. This configuration allows for "float," as described above in connection with FIG. 6D.

Though members $\mathbf{1014}_1$ . . . $\mathbf{1014}_4$ may have any suitable shape, in the embodiment illustrated, members $\mathbf{1014}_1$ . . . $\mathbf{1014}_4$ are shaped to provide a desired insertion force as connectors are mated. As shown in FIGS. 10A and 10B, each of members $\mathbf{1014}_1$ . . . $\mathbf{1014}_4$ has a distal portion 1030. Members $\mathbf{1014}_1$ . . . $\mathbf{1014}_4$ are tapered such that the distal portions 1030 are narrow relative to other portions of the member. The tapered distal end 1030 can provide an initial low insertion force, while other portions of members $\mathbf{1014}_1$ . . . $\mathbf{1014}_4$ may be shaped to provide a higher force to retain a mating contact within contact 900 when a mating contact is fully inserted into contact 900.

FIG. 10B is a side view of contact 900 within a housing. Walls $\mathbf{1040}_1$ and $\mathbf{1040}_2$ may be portions of the housing, such as housing 720 (FIG. 9). Walls $\mathbf{1040}_1$ and $\mathbf{1040}_2$ may be spaced and shaped to provide a slot 792 that can receive a portion of a mating connector between opposing ones of the members $\mathbf{1014}_1$ . . . $\mathbf{1014}_4$. Members, such as $\mathbf{1014}_1$ and $\mathbf{1014}_2$, may contain contact surfaces, such as $\mathbf{1034}_1$ and $1034_2$. In the embodiment illustrated, contact surfaces $1034_1$ and $1034_2$ face inwards, towards the center of slot 792 such that when a portion of a mating connector is inserted in slot 792, contact surfaces $1034_1$ and $1034_2$ may press against a corresponding mating contact surface on that portion.

Figure 11C:
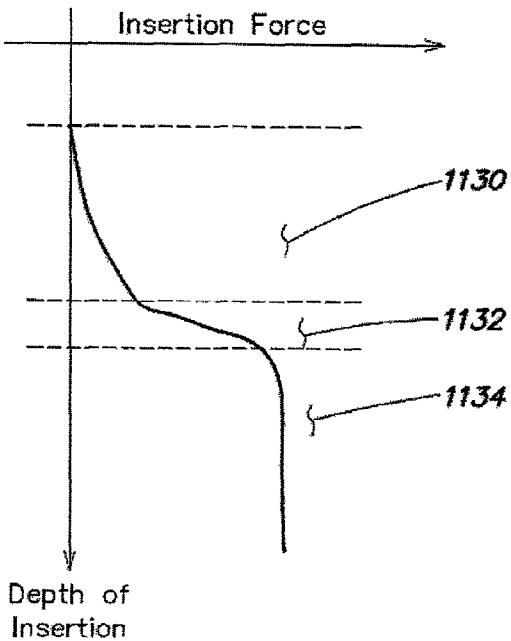
FIG. 11C is a graph showing insertion force of the connector of FIGS. 11A and 11B during a mating sequence.
Figure 11B:
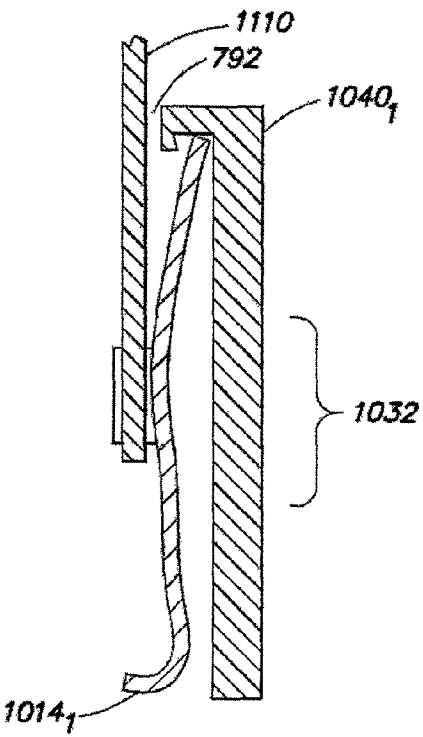
FIG. 11B is a cross sectional view of the portion of the contact of FIG. 11A during a later stage of the mating sequence.
Figure 11A:
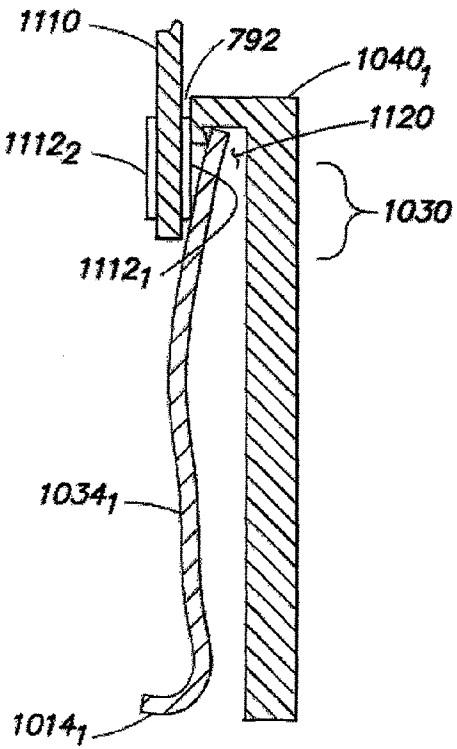
FIG. 11A is a cross sectional view of a portion of the contact of FIG. 10B during a first portion of a mating sequence.

In the embodiment illustrated, the insertion force, or conversely the retention force, generated by a contact 900 may be generated by different portions of the members $1014_1$ . . . $1014_4$, at different times, depending on how far at portion of a mating connector is inserted into slot 792. FIGS. 11A and 11B illustrate a mating sequence and FIG. 11C is a graph depicting insertion force as a function of insertion distance.

FIG. 11A shows a portion 1110 of a mating connector being inserted in slot 792. In FIG. 11A, only member $1014_1$ is shown. Embodiments of a contact may be constructed using only one member. Other embodiments may have multiple members per contact. In embodiments in which a contact is formed with multiple members, additional members may operate during a mating sequence in the same way as member $1014_1$. Accordingly, only one member is illustrated for simplicity.

Portion 1110 may be a portion of any suitable connector. For example, portion 1110 may be a forward portion of a wafer 130 (FIG. 1*d*) or 630 (FIG. 6A). Portion 1110 may contain one or more mating contact portions that engage members, such as member $1014_1$. In the embodiment illustrated, mating contact portions are pads, of which pads $1112_1$ and $1112_2$ are shown. Here, pads $1112_1$ and $1112_2$ form opposing surfaces of one conductive element, though any suitable configuration of mating contact portions may be used.

FIG. 11A illustrates the position of portion 1110 at the start of a mating sequence. As portion 1110 enters slot 792, it contacts distal portion 1030. Because distal portion 1030 is tapered to be relatively thin, it is compliant and therefore easily deflected by force exerted on distal portion 1030 by portion 1110 when portion 1110 is first inserted. In the embodiment shown, distal portion 1030 is initially spaced from wall $1040_1$ by a space 1120, creating a space into which distal portion 1030 may be deflected while still moving freely.

To prevent damage to distal portion 1030 during insertion of portion 1110, walls $1040_1$ and $1040_2$ may have retaining features that prevent the distal ends 1030 of members $1014_1$ . . . $1014_4$ from extending into slot 792, which can cause stubbing when a mating portion of a connector is inserted into slot 792. In the embodiment illustrated, lips $1042_1$ and $1042_2$ (FIG. 10B) adjacent to an opening into slot 792 act as retaining features. However, retaining features of any suitable construction may be used.

FIG. 11B illustrates the position of portion 1110 at a later time in the mating sequence. In the configuration illustrated, portion 1110 has been inserted into slot 792 a sufficient distance that pad $1112_1$ engages arched portion 1032. In this configuration, distal end 1030 of member $1014_1$ has been pressed through space 1120 and presses against a surface that stops its motion. In the embodiment illustrated, that surface is a portion of wall $1040_1$. However, any suitable structure may be used to restrain motion of distal end 1030.

In the embodiment illustrated, distal end 1030 rests in a corner of wall $1040_1$. In this configuration, distal end is restrained from moving away from slot 792. Member $1014_1$ is also restrained from moving along wall $1040_1$ as portion 1110 presses against arched portion 1032. Consequently, as portion 1110 presses against arched portion 1032, member $1014_1$ is placed in compression. Because placing arched portion 1032 in compression requires more force than deflecting distal portion 1030, the insertion force increases as portion 1110 is inserted to the point that it engages arched portion 1032.

The insertion force during such a mating sequence is shown in FIG. 11C. In region 1130, portion 1110 initially makes contact with member $1014_1$, resulting in a relatively low force. Because member $1014_1$ is tapered, the force increases non-linearly as wider, and therefore stiffer, segments of member $1014_1$ are deflected as the insertion distance increases.

Thus, region 1130 indicates a low, but increasing insertion force as portion 1110 is initially inserted. The tapered configuration of member $1014_1$ may be used in connectors for which a low initial insertion force is desired, such as in embodiments in which float is desired. With low initial insertion force, two mating connectors may be easily aligned at the outset of the mating sequence.

As portion 1110 is inserted further, the insertion force increases, as depicted by region 1132. Region 1132 corresponds to the portion 1110 pressing against arched portion 1032. As can be seen, in region 1132 the insertion force increases at a greater rate than in region 1130.

When portion 1110 is inserted in slot 792 until the forward edge reaches the apex of arched portion 1032, further insertion does not further compress arched portion 1032. At that point, the insertion force does not increase, even if portion 1110 is further inserted. However, in the embodiment illustrated, mating surface $1034_1$ (FIG. 10B) presses against surface 112, with the force illustrated in region 1134. As a result, there is a relatively high contact force, corresponding to the force illustrated in region 1134. This relatively high contact force may retain portion 1110 in place and may provide a good electrical connection between the mating contact portions. However, because this high contact force creates a high insertion force over only a small portion of the insertion sequence, mechanical structures to align mating connectors and generate the required insertion force may be simplified.

FIGS. 11A, 11B and 11C illustrate that contact 900 may be shaped to provide a desired force profile during a mating sequence. By omitting or incorporating a taper or otherwise controlling the dimensions of the distal end 1030, the initial mating force can be controlled. Be controlling the dimensions of a central portion, such as arched portion 1032, as well as the location at which distal end 1030 becomes restrained, the retention force of the contact may be controlled.

Figure 12:
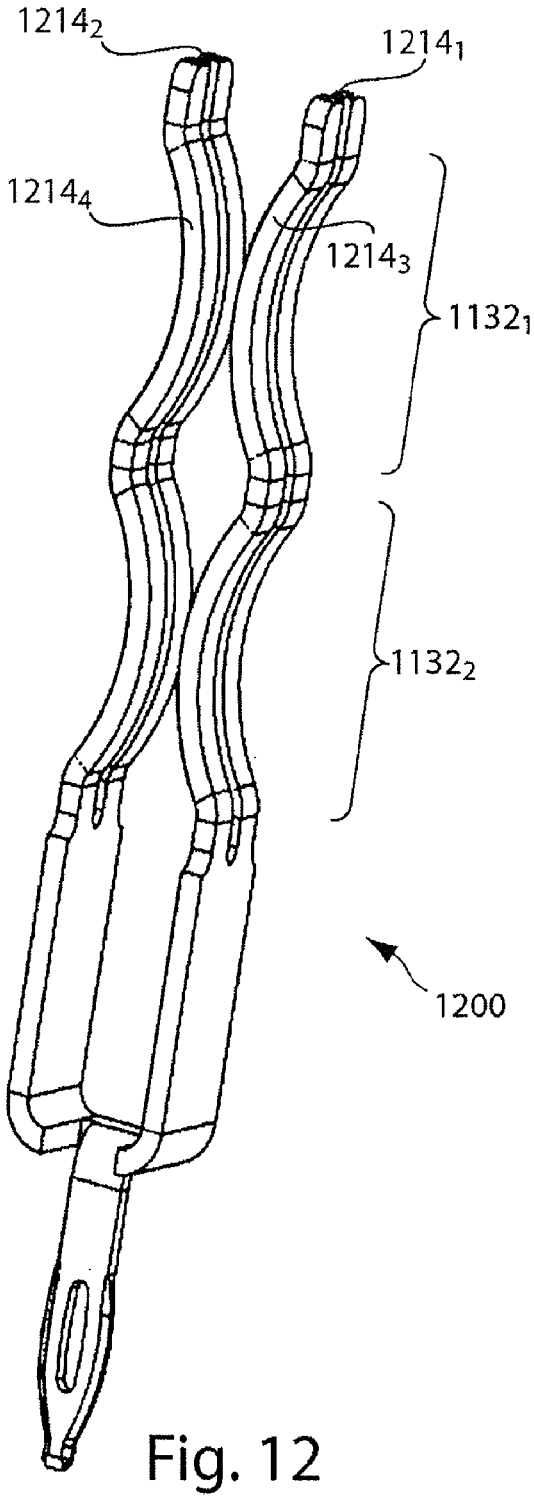
FIG. 12 is a sketch of a contact that may be used in the backplane connector of FIG. 9 according to an alternative embodiment of the invention.

FIG. 12 illustrates an alternative embodiment of a contact 1200 with a different shape to provide a different insertion force profile. Contact 1200, like contact 900 includes four elongated members $1214_1$ . . . $1214_4$. In the embodiment illustrated, each of the each of the elongated members contains two arched portions, $1132_1$ and $1132_2$. Such a configuration may provide two stepped increases in insertion force as a mating connector portion engages contract 1200. The first stepped increase may occur as the mating contact portion is inserted to the point that the leading edge engages the mating arched portion $1132_1$. A second stepped increase may occur as the leading edge engages arched portion $1132_2$. In the embodiment illustrated, each arched portion $1132_1$ and $1132_2$ is approximately the same size such that each step increase in insertion force may be approximately equal. However, the invention is not limited in that regard and any suitable configuration may be used to provided a desired insertion force profile.

Accordingly, the specific configuration of the elongated members of a contact is not a limitation of the invention. For example, though elongated members with rounded arches are illustrated, the invention is not so limited. An arch may be formed with straight segments that join at a defined point.

While particular embodiments have been chosen to illustrate the invention, it will be understood by those skilled in the art that various changes and modifications can be made therein without departing from the scope of the invention as defined in the appended claims.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. An electronic assembly, comprising:

a) a first connector having:

i) a housing having a plurality of parallel slots therein, each of the plurality of parallel slots extending in a first direction; and ii) a plurality of conductive elements disposed adjacent each of the plurality of parallel slots, each of the plurality of conductive elements having a mating contact portion within a respective slot;

b) a second connector comprising a plurality of wafers held in parallel, each wafer comprising:

i) a housing having a mating segment adapted to fit within a slot of the plurality of parallel slots;

ii) a plurality of conductive elements, each conductive element having a mating contact portion exposed in at least one surface of the mating segment, the mating contact portions adapted and arranged to engage a mating contact portion within the first connector, wherein each mating segment is adapted and arranged to allow float of the second connector relative to the first connector in the first direction.

2. The electronic assembly of claim 1, wherein the housing of the first connector has a first dimension along the first direction, and each of the mating segments is bounded by sidewalls spaced by a second dimension, larger than the first dimension.

3. The electronic assembly of claim 1, wherein:

the mating contact portion of each of the plurality of conductive elements in the second connector comprises a first pad and a second pad, the first pad and the second pad being disposed on opposing surfaces of a respective mating segment;

each of the plurality of conductive elements of the first connector comprises at least a first, second, third and fourth beams having respective first, second, third and fourth contact surfaces thereon, the first and second contact surfaces are adapted and configured to engage the first pad of a corresponding mating contact portion of a conductive element in the second connector;

the third and fourth contact surfaces are adapted and configured to engage the second pad of the corresponding mating contact portion of the conductive element in the second connector; and the first beam has a length different than a length of the second beam and the third beam has a length different than a length of the fourth beam.

4. The electronic assembly of claim 1, wherein the mating contact portion of each of the plurality of conductive elements in the second connector comprises a first pad and a second pad, the first pad and the second pad being disposed on opposing surfaces of a respective mating segment;

each of the plurality of conductive elements of the first connector comprises at least a first, second, third and fourth contact surfaces;

for each of the plurality of conductive elements of the first connector, the first and second contact surfaces are adapted and arranged to engage a first pad of a corresponding conductive element in the second connector, and the third and fourth contact surfaces are adapted and arranged to engage a second pad of the corresponding conductive elements in the second connector.

5. An electronic assembly comprising:

a) a first connector comprising:

i) a plurality of first conductive elements, each first conductive element comprising a first pad and a second pad;

ii) a plurality of mating segments, each mating segment having opposing first and second surfaces, wherein a first pad of each first conductive element is disposed on a first surface and a second pad of each first conductive element is disposed on a second surface of a segment of the plurality of segments; and b) a second connector comprising a plurality of second conductive elements, each second conductive element positioned to engage a corresponding first conductive element, and each second conductive element comprising:

at least a first, second, third and fourth contact surfaces, wherein the first and second contact surfaces are adapted and arranged to engage a first pad of the corresponding first conductive element and the third and fourth contact surfaces are adapted and arranged to engage a second pad of the corresponding first conductive element; and a conductive structure interconnecting the first, second, third and fourth contact surfaces.

6. The electronic assembly of claim 5, wherein:

the first connector comprises a plurality of subassemblies and each of the plurality of mating segments is disposed on a subassembly; and the second connector comprises a housing having a plurality of slots, each slot being adapted and configured to receive a mating segment of one subassembly.

7. The electronic assembly of claim 5, wherein the first, second, third and fourth contact surfaces are disposed on ends of first, second, third and fourth beams, respectively, and the first beam has a length different than a length of the second beam and the third beam has a length different than a length of the fourth beam.

8. The electronic assembly of claim 7, wherein the first pad and the second pad of each first conductive element comprise opposing sides of a single conducting member.

9. An electronic assembly comprising:

a) a first connector comprising a plurality of wafers aligned in parallel, each wafer comprising:

i) an array of first contacts, each first contact comprising a first pad and a second pad;

ii) an insulating member having opposing first and second surfaces, wherein a first pad of each first contact is disposed on the first surface and a second pad of each conductive element is disposed on the second surface; and b) a second connector comprising:

i) a housing having a plurality of slots, each slot adapted and configured to receive an insulating member of a wafer of the plurality of wafers;

ii) a plurality of second contacts, each second contact positioned within a slot of the plurality of slots to engage a corresponding first contact, and each second contact comprising:

at least a first, second, third and fourth beams having respective first, second, third and fourth contact surfaces thereon, wherein the first and second contact surfaces are adapted and configured to engage a first pad of the corresponding first contact and the third and fourth contact surfaces are adapted and arranged to engage a second pad of the corresponding first contact, and the first beam has a length different than a length of the second beam and the third beam has a length different than a length of the fourth beam; and a conductive portion interconnecting the first, second, third and fourth beams.

10. The electronic assembly of claim 9, wherein each of the plurality of second contacts comprises an integral member formed from one sheet of metal.

* * * * *